US009328564B2

(12) United States Patent
Zhang et al.

(10) Patent No.: US 9,328,564 B2
(45) Date of Patent: May 3, 2016

(54) CUTTING ELEMENTS RETAINED WITHIN SLEEVES

(71) Applicant: SMITH INTERNATIONAL, INC., Houston, TX (US)

(72) Inventors: Youhe Zhang, Spring, TX (US); Jibin Shi, Spring, TX (US); Yuri Burhan, Spring, TX (US); Chen Chen, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 398 days.

(21) Appl. No.: 13/786,085

(22) Filed: Mar. 5, 2013

(65) Prior Publication Data

US 2013/0333953 A1 Dec. 19, 2013

Related U.S. Application Data

(60) Provisional application No. 61/609,229, filed on Mar. 9, 2012, provisional application No. 61/609,692, filed on Mar. 12, 2012, provisional application No. 61/712,791, filed on Oct. 11, 2012.

(51) Int. Cl.

| | |
|---|---|
| ***E21B 10/573*** | (2006.01) |
| ***E21B 10/42*** | (2006.01) |
| ***E21B 10/627*** | (2006.01) |
| ***E21B 10/633*** | (2006.01) |

(52) U.S. Cl.

CPC ..... *E21B 10/42* (2013.01); *E21B 10/573* (2013.01); *E21B 10/5735* (2013.01); *E21B 10/627* (2013.01); *E21B 10/633* (2013.01)

(58) Field of Classification Search

CPC .... E21B 10/573; E21B 10/627; E21B 10/633

See application file for complete search history.

(56) References Cited

U.S. PATENT DOCUMENTS

| | | | |
|---|---|---|---|
| 4,104,344 | A | 8/1978 | Pope et al. |
| 4,288,248 | A | 9/1981 | Bovenkerk et al. |
| 4,553,615 | A | 11/1985 | Grainger |
| 5,127,923 | A | 7/1992 | Bunting et al. |
| 5,906,245 | A | 5/1999 | Tibbitts et al. |
| 7,703,559 | B2 | 4/2010 | Shen et al. |
| 7,717,523 | B2 | 5/2010 | Weaver |
| 7,762,359 | B1 | 7/2010 | Miess |
| 7,837,277 | B2 | 11/2010 | Weaver |

(Continued)

FOREIGN PATENT DOCUMENTS

| | | | |
|---|---|---|---|
| CN | 1651711 | A | 8/2005 |
| WO | 9605404 | A1 | 2/1996 |

(Continued)

OTHER PUBLICATIONS

International Search Report and Written Opinion issued in PCT/US2013/029771 on Jun. 4, 2013, 12 pages.

(Continued)

*Primary Examiner* — Giovanna C Wright

(57) ABSTRACT

A cutter assembly may include a sleeve; and at least one cutting element having a lower spindle portion retained in the sleeve and a portion of the cutting element interfacing an axial bearing surface of the sleeve, wherein an outer diameter D of the cutting element and a radial length T of a substantially planar portion of the axial bearing surface of the sleeve have the following relationship: (1/25)D≤T≤(1/4)D.

18 Claims, 36 Drawing Sheets

(56) References Cited

U.S. PATENT DOCUMENTS

| | | | |
|---|---|---|---|
| 8,091,655 | B2 | 1/2012 | Shen et al. |
| 8,413,746 | B2 | 4/2013 | Shen et al. |
| 2006/0260846 | A1 | 11/2006 | Portwood et al. |
| 2007/0144789 | A1 | 6/2007 | Johnson et al. |
| 2007/0278017 | A1 | 12/2007 | Shen et al. |
| 2010/0108403 | A1 | 5/2010 | Keshavan |
| 2010/0314176 | A1 | 12/2010 | Zhang et al. |
| 2012/0273280 | A1 | 11/2012 | Zhang et al. |
| 2012/0273281 | A1 | 11/2012 | Burhan et al. |
| 2013/0199857 | A1 | 8/2013 | Schwefe et al. |
| 2013/0220707 | A1 | 8/2013 | Shen et al. |
| 2014/0054094 | A1 | 2/2014 | Burhan et al. |
| 2014/0174834 | A1 | 6/2014 | Zhang et al. |

FOREIGN PATENT DOCUMENTS

| | | | |
|---|---|---|---|
| WO | 2007024171 | A1 | 3/2007 |
| WO | 2013074898 | A1 | 5/2013 |
| WO | 2013101860 | A1 | 7/2013 |

OTHER PUBLICATIONS

Office Action issued in Chinese Patent Appl. No. 201380021302.0 on Aug. 24, 2015, 11 pages.

Office Action issued in European Patent Appl. No. 13757695.5 on Nov. 11, 2015, 5 pages.

Search Report issued in European Patent Appl. No. 13757695.5 on Nov. 11, 2015, 3 pages.

CUTTING ELEMENTS RETAINED WITHIN SLEEVES

CROSS-REFERENCE TO RELATED APPLICATIONS

This application claims the benefit of U.S. Provisional Patent Application Ser. Nos. 61/609,229 filed Mar. 9, 2012; 61/609,692 filed Mar. 12, 2012; and 61/712,791 filed Nov. 11, 2012; all of which are incorporated herein by reference in their entireties.

BACKGROUND

1. Technical Field

Embodiments disclosed herein relate generally to polycrystalline diamond compact cutters and bits or other cutting tools incorporating the same. More particularly, embodiments disclosed herein relate to cutting elements retained within a sleeve and bits or other cutting tools incorporating the same.

2. Background Art

Various types and shapes of earth boring bits are used in various applications in the earth drilling industry. Earth boring bits have bit bodies which include various features such as a core, blades, and cutter pockets that extend into the bit body or roller cones mounted on a bit body, for example. Depending on the application/formation to be drilled, the appropriate type of drill bit may be selected based on the cutting action type for the bit and its appropriateness for use in the particular formation.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (which may be made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are generally bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration and erosive forces have caused drill bit failure due to loss of one or more cutters, or due to breakage of the blades.

In some applications, a compact of polycrystalline diamond (PCD) (or other ultrahard material) is bonded to a substrate material, which may be a sintered metal-carbide to form a cutting structure. PCD comprises a polycrystalline mass of diamonds (often synthetic) that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A PDC cutter may be formed by placing a sintered carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn integrally bonded to the substrate. The substrate may be made of a metal-carbide composite material, such as tungsten carbide-cobalt. The deposited diamond layer is often referred to as the "diamond table" or "abrasive layer."

An example of PDC bit having a plurality of cutters with ultra hard working surfaces is shown in FIGS. 1A and 1B. The drill bit 200 includes a bit body 210 having a threaded upper pin end 211 and a cutting end 215. The cutting end 214 includes a plurality of ribs or blades 220 arranged about the rotational axis L (also referred to as the longitudinal or central axis) of the drill bit and extending radially outward from the bit body 210. Cutting elements, or cutters, 250 are embedded in the blades 220 at predetermined angular orientations and radial locations relative to a working surface and with a desired back rake angle and side rake angle against a formation to be drilled.

A plurality of orifices 216 are positioned on the bit body 210 in the areas between the blades 220, which may be referred to as "gaps" or "fluid courses." The orifices 216 are commonly adapted to accept nozzles. The orifices 216 allow drilling fluid to be discharged through the bit in selected directions and at selected rates of flow between the blades 220 for lubricating and cooling the drill bit 200, the blades 220 and the cutters 250. The drilling fluid also cleans and removes the cuttings as the drill bit 200 rotates and penetrates the geological formation. Without proper flow characteristics, insufficient cooling of the cutters 250 may result in cutter failure during drilling operations. The fluid courses are positioned to provide additional flow channels for drilling fluid and to provide a passage for formation cuttings to travel past the drill bit 200 toward the surface of a wellbore (not shown).

Referring to FIG. 1B, a top view of a prior art PDC bit is shown. The cutting face 218 of the bit shown includes six blades 220-225. Each blade includes a plurality of cutting elements or cutters generally disposed radially from the center of cutting face 218 to generally form rows. Certain cutters, although at differing axial positions, may occupy radial positions that are in similar radial position to other cutters on other blades.

Cutters may be attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation. Specifically, alloys suitable for brazing cutting elements with diamond layers thereon have been limited to a couple of alloys which offer low enough brazing temperatures to avoid damage to the diamond layer and high enough braze strength to retain cutting elements on drill bits.

A substantial factor in determining the longevity of PDC cutters is the exposure of the cutter to heat. Polycrystalline diamond may be stable at temperatures of up to 700-750° C. in air, above which observed increases in temperature may result in permanent damage to and structural failure of polycrystalline diamond. This deterioration in polycrystalline diamond is due to the substantial difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. As a cutting element contacts the formation, a wear flat develops and frictional heat is induced. As the cutting element is continued to be used, the wear flat will increase in size and further induce frictional heat. The heat may build-up that may cause failure of the cutting element due to thermal mis-match between diamond and catalyst discussed above. This is particularly true for cutters that are immovably attached to the drill bit, as conventional in the art.

Accordingly, there exists a continuing need to develop ways to extend the life of a cutting element.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutter assembly that includes a sleeve; and at least one cutting element having a lower spindle portion retained in the sleeve and a portion of the cutting element interfacing an axial bearing surface of the sleeve, wherein an outer diameter D of the cutting element and a radial length T of a substantially planar portion of the axial bearing surface of the sleeve have the following relationship: $(1/25)D \leq T \leq (1/4)D$.

In one aspect, embodiments disclosed herein relate to a cutter assembly that includes a sleeve; and at least one cutting element having a lower spindle portion retained in the sleeve and a portion of the cutting element interfacing an axial bearing surface of the sleeve, wherein an outer diameter D of the cutting element, a radial length T of an outermost substantially planar portion of the axial bearing surface of the sleeve, and the thickness d of the sleeve have the following relationship: $T \leq d \leq (1/3)D$.

In another aspect, embodiments disclosed herein relate to a cutter assembly that includes a sleeve; and at least one cutting element comprising: a carbide substrate and an ultrahard layer thereon, wherein a portion of the carbide substrate comprises a lower spindle portion retained in the sleeve and an upper portion interfacing an axial bearing surface of the sleeve, wherein an axial extension U of the carbide substrate from the axial bearing surface to the ultrahard layer and a thickness S of the ultrahard layer have the following relationship: $U/S \geq 0.5$.

In yet another aspect, embodiments disclosed herein relate to a cutter assembly that includes a sleeve; and at least one cutting element comprising: a carbide substrate and an ultrahard layer thereon, wherein a portion of the carbide substrate comprises a lower spindle portion retained in the sleeve and an upper portion interfacing an axial bearing surface of the sleeve, wherein an axial extension U of the carbide substrate from the axial bearing surface to the ultrahard layer, a thickness S of the ultrahard layer, and a height L of the cutting assembly have the following relationship: $U+S \leq 0.75L$.

In another aspect, embodiments disclosed herein relate to a cutter assembly that includes a sleeve; at least one cutting element having lower spindle portion retained in the sleeve and an upper portion interfacing an axial bearing surface of the sleeve, wherein the lower spindle portion comprises a retention cavity therein; and a retention element interfacing the retention cavity to retain the cutting element in the sleeve, wherein a diameter J of the lower spindle portion axially above the retention cavity and a diameter j of the lower spindle portion axially below the retention cavity have the following relationship: $J-0.07 \leq j \leq J$.

In yet another aspect, embodiments disclosed herein relate to a downhole cutting tool that includes a cutting element support structure having at least one cutter pocket formed therein; and a cutter assembly of any of above-mentioned types disposed in the cutter pocket.

Other aspects and advantages of the claimed subject matter will be apparent from the following description and the appended claims.

DETAILED DESCRIPTION

In one aspect, embodiments of the present disclosure relate to a cutting elements retained within a sleeve structure such that the cutter is free to rotate about its longitudinal axis. In another aspect, embodiments of the present disclosure relate to a cutting elements retained within a sleeve structure such that the cutter is mechanically retained (and not rotatable) within the sleeve structure. The cutter assembly of a cutting element and a sleeve may be used in a drill bit or other cutting tools.

In the following discussion and in the claims, the terms "including" and "comprising" are used in an open-ended fashion, and thus should be interpreted to mean "including, but not limited to . . . ." Further, the terms "axial" and "axially" generally mean along or substantially parallel to a central or longitudinal axis, while the terms "radial" and "radially" generally mean perpendicular to a central, longitudinal axis.

Figure 1A:
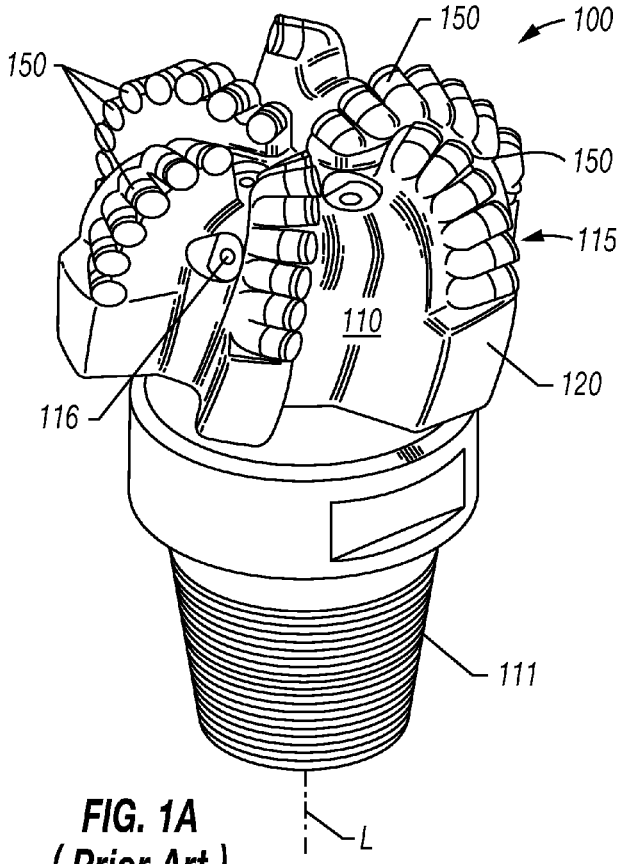
FIG. 1A ( Prior Art )
FIGS. 1A and 1B show a side and top view of a conventional drag bit.
Figure 1B:
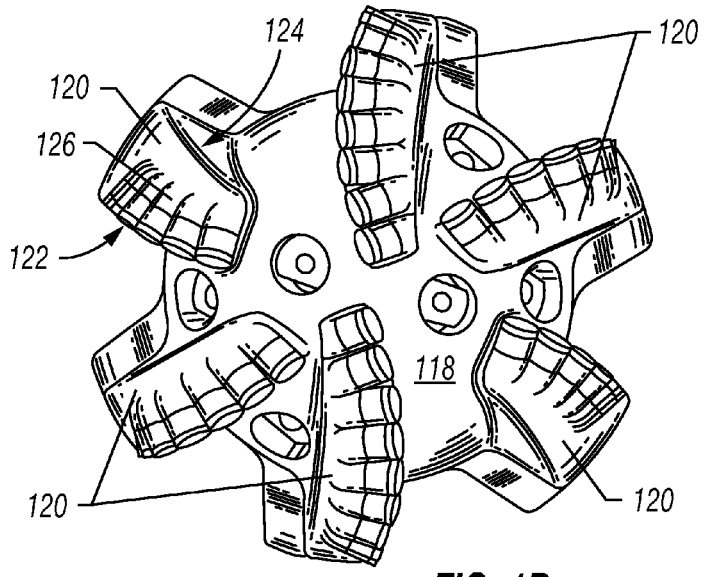
FIG. 1B ( Prior Art )
Figure 2:
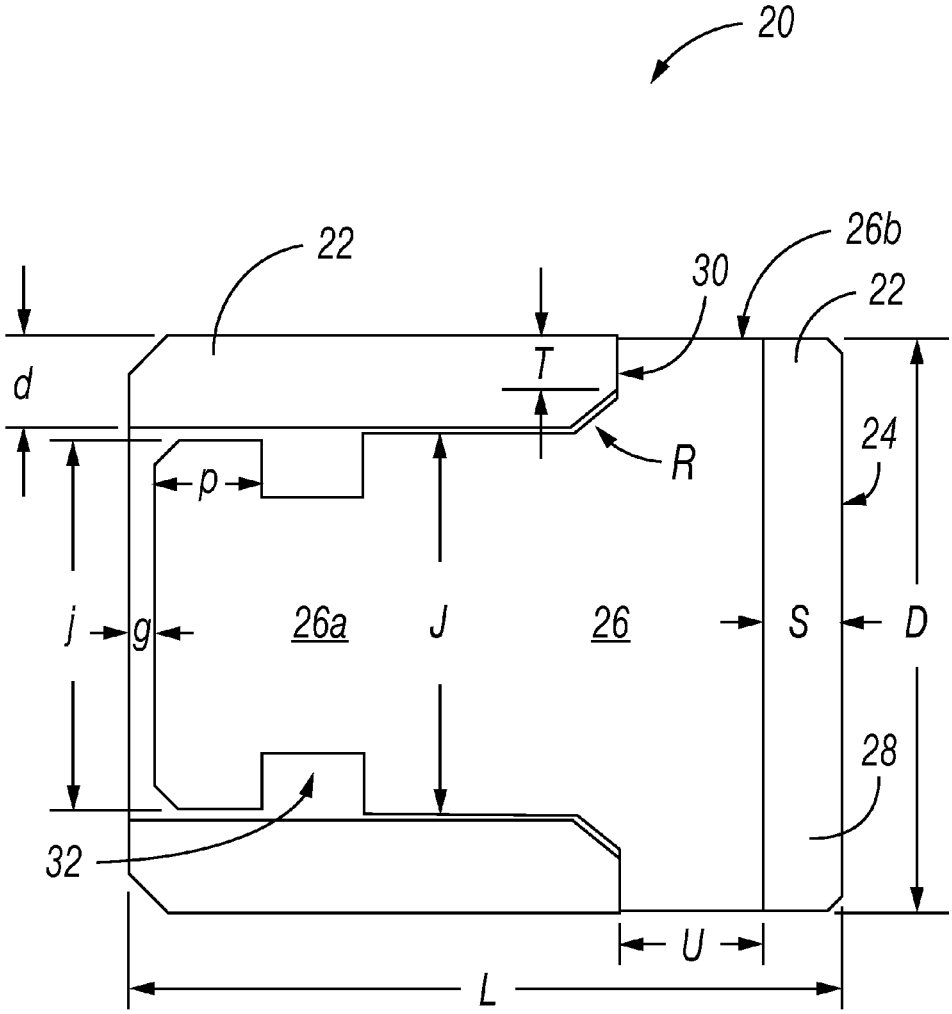
FIG. 2 shows a cutting assembly according to one embodiment.
Figure 11:
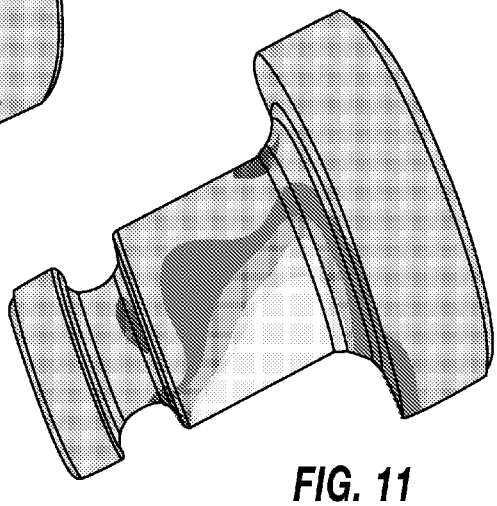
Figure 12:
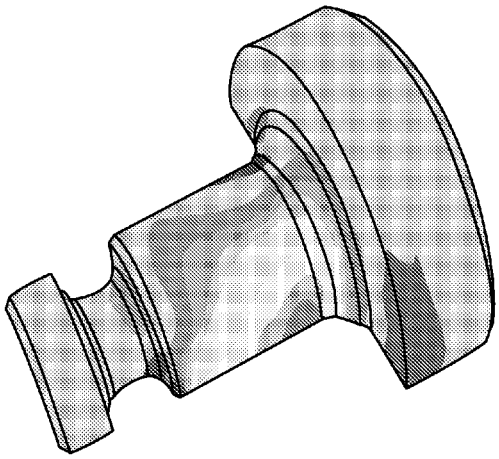
Figure 13:
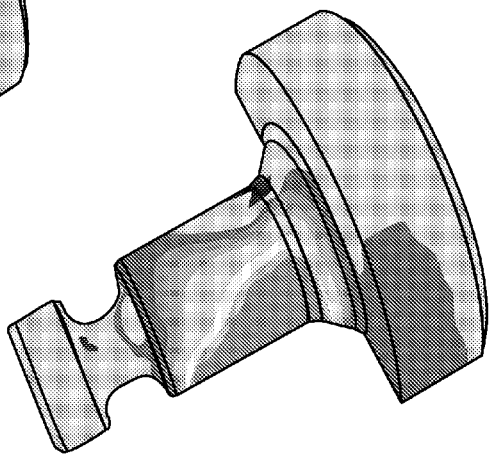

FIG. 2 illustrates a cutter assembly according to one embodiment of the present disclosure. Cutter assembly 20 includes a sleeve 22 and a cutting element 24 retained within the sleeve. Cutting element 24 may, in some embodiments, be formed of two components, carbide substrate 26 and an ultra-hard material layer 28 disposed on an upper surface of the carbide substrate 26. A lower portion 26*a* of the carbide substrate 26 forms a spindle around which the sleeve 22 is disposed. The cutting element 24 may be retained within the sleeve by a variety of retention mechanisms (not shown) such as by retention balls, springs, pins, etc. No limitation exists on the scope of the present disclosure; however, various examples of such types of retention mechanisms (as well as other variations on the cutting assemblies suitable for use in the present disclosure) include those disclosed in U.S. Patent Application Nos. 61/561,016, 61/581,542, 61/556,454, 61/479,151; U.S. Patent Publication No. 2010/0314176; and U.S. Pat. No. 7,703,559, all of which are assigned to the present assignee and herein incorporated by reference in their entirety. Sleeve 22 and cutting element 24 may have substantially the same outer diameter as each other in some embodiments, but it is also within the scope of the present disclosure that the sleeve 22 may have a greater outer diameter than cutting element, such as shown in FIGS. 11A-B of U.S. Pat. No. 7,703,559 mentioned above. In some embodiments, retention mechanism may limit the axial movement or displacement of the cutting element 24 with respect to sleeve 22. In such embodiments, the cutting elements may be rotatable within the sleeve, i.e., about the longitudinal axis of the cutting element 20. In other particular embodiments, retention mechanism may limit the axial movement or displacement as well as rotational movement of the cutting element 24 with respect to sleeve 22.

As mentioned above, cutting element 24 (and substrate 26 of the cutting element 24 in the embodiment illustrated) may include at a lower portion thereof, a spindle 26*a*. Cutting element 24, axially above the sleeve 22, may extend to a larger outer diameter D, at an upper portion 26*b* thereof. Thus, upper portion 26*b* may interface the sleeve 22 at an axial bearing surface 30. According to some embodiments of the present disclosure, an axial bearing surface may transition from an outer substantially planar surface to an inner diameter of the sleeve. The transition may be radiused or tapered. In particular embodiments, there may be a radiused transition between the outer substantially planar surface to the inner diameter. Examples of suitable radii according to some embodiments include radii ranging from 0.005 to 0.125 inches and from 0.020 to 0.060 inches in other particular embodiments. However, in one or more embodiments, it may be worthwhile to select the radius based on the outer diameter D of the cutting element 24. For example, an upper limit of the radius may be one-fourth the diameter D of the cutting element 24. When the radius is too small, the cutter may be weakened under bending loads and a sharper corner may lead to stress concentrations. In contrast, if the radius is too large, it may limit the radial length T of the sleeve and may also cause interference with the sleeve under frontal loading. In one or more particular embodiments, the lower limit of the radius may be 0.04D, 0.05D, 0.06D, or 0.07D, and the upper limit may be any of 0.16D, 0.15D, 0.13D, or 0.12D, where any lower limit can be used in combination with any upper limit. It is also within the scope of the present disclosure that the transition may include a multiple stepped taper or transition having smoothed or rounded edges.

Relationships between various cutting element 24 dimensions are described below. Cutting element 24 dimensions according to some embodiments are shown in FIG. 2 and may be referenced during description of dimension relationships, although the dimensional relationships may not be shown to scale.

Further, simulations of cutting element performance were performed using finite element analysis ("FEA") to model performance of various dimensional relationships. Suitable software to perform such FEA includes, for example, but is not limited to, ABAQUS (available from ABAQUS, Inc.), MARC (available from MSC Software Corporation), and ANSYS (available from ANSYS, Inc.). The simulations were performed using the following assumptions: the cutting element included a tungsten carbide substrate having a transverse rupture strength of 440 ksi, an ultimate tensile strength of 220 ksi, and an ultimate compressive strength of 880 ksi; a cutting load of 2,000 lbf was applied to the cutting element; and a vertical load of 3,000 lbf was applied to the cutting element.

Figure 3:
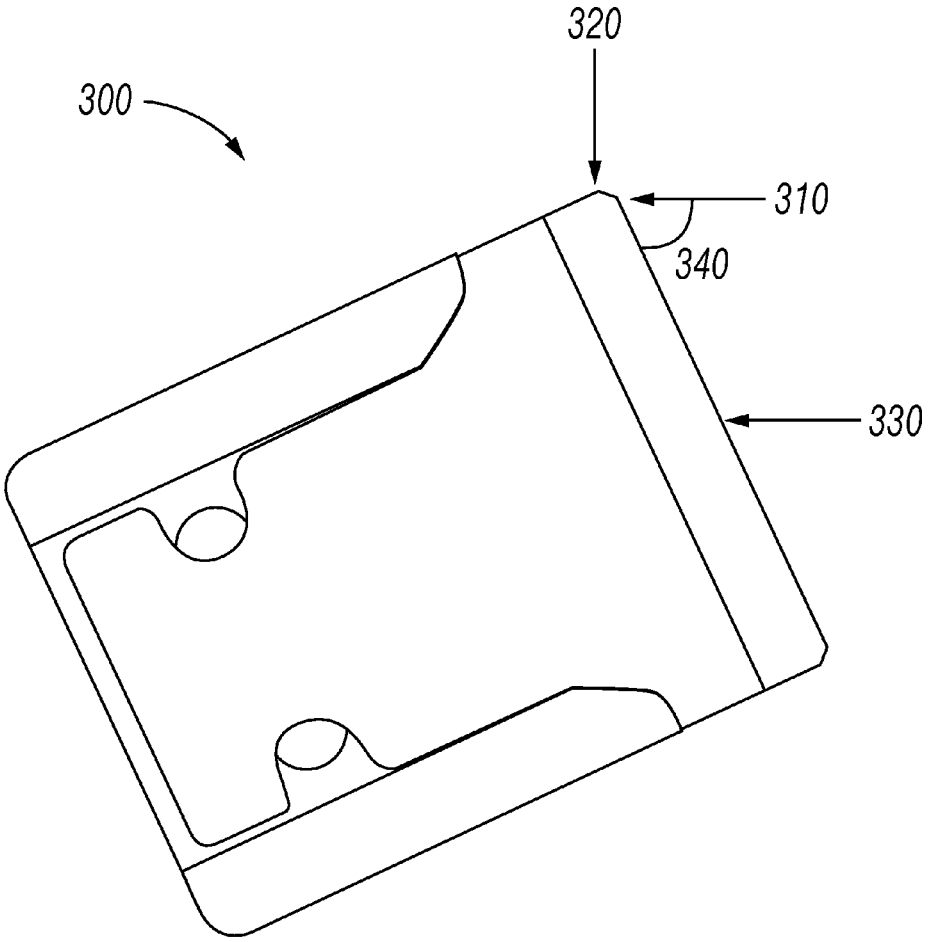
FIG. 3 shows a cross sectional view of a cutting element assembly according to embodiments of the present disclosure.

As shown in FIG. 3, a cutting load 310 refers to a force directed to a cutting face 330 of a cutting element 300, while a vertical load 320 refers to a force directed to the cutting element in a direction transverse to the cutting load 310. In applications including drilling a borehole, the vertical load 320 may represent the force applied from the bottom of a borehole, while the cutting load 310 may represent the force applied from the direction of cutting. However, in multi-directional drilling applications, the vertical load 320 may represent force applied from a direction other than vertical. Further, a cutting element may be positioned relative to a formation being drilled at various angles (e.g., at various back rake and side rake positions), such that the angle between the cutting load 310 and the cutting face 330 varies. For example, a cutting load 310 may be direct to a cutting face 330 at an angle 340 less than or equal to 90 degrees.

Outer Diameter (D) and Sleeve Radial Length (T)

According to some embodiments of the present disclosure, a cutting element 24 may have an outer diameter D, and axial bearing surface 30 may include a substantially planar surface extending to the outer diameter of the sleeve having a radial length T. In particular embodiments, D and T may have the following relationship: $(1/25)D \leq T \leq (1/4)D$. In other embodiments, T may have a lower limit of any of (1/20)D, (1/15)D, (1/12)D, (1/10)D, or (1/8)D, and an upper limit of any of (1/5)D, (1/6)D, (1/8)D, (1/10)D, or (1/12)D, where any upper limit can be used in combination with any lower limit. In one or more particular embodiments, T may have a lower limit of (1/12)D and an upper limit of (1/9)D or (1/10)D. For example, for a cutter having a diameter of 13 mm (0.529 inches), T may range in particular embodiments from 0.025 to 0.050 inches, and for a cutter having a diameter of 16 mm (0.625 inches), T may range in particular embodiments from 0.030 to 0.070 inches. However, lesser or greater values of T may be suitable, in accordance with the mentioned relationship.

Figure 4:
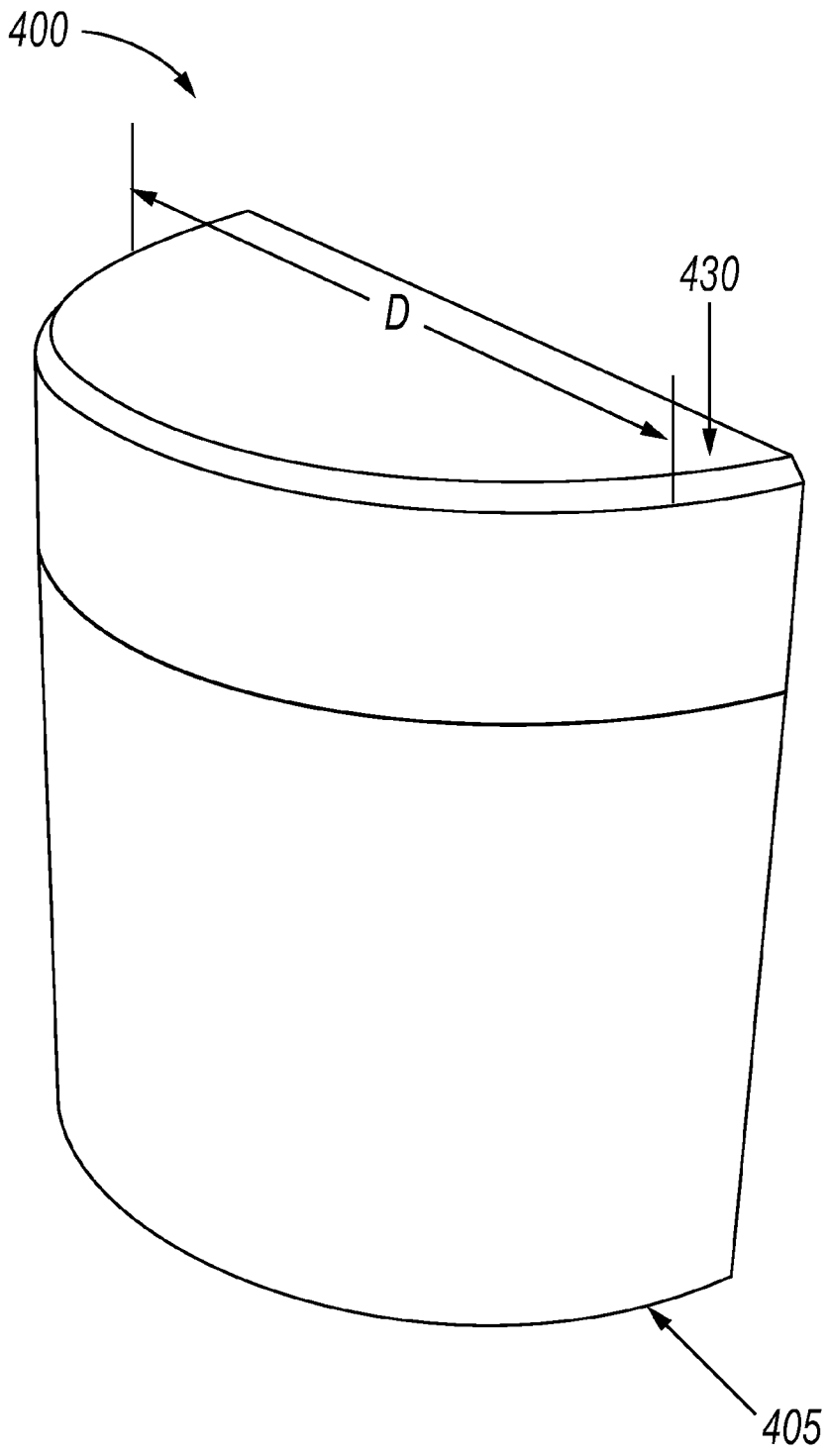
FIG. 4 shows a partial view of a cutting element assembly according to embodiments of the present disclosure.
Figure 5:
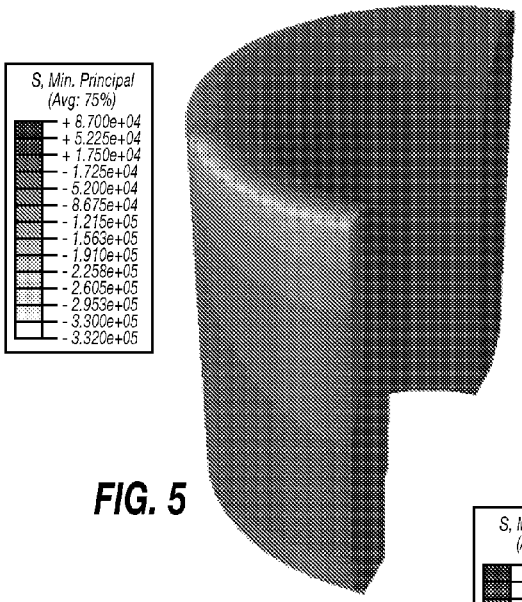
FIGS. 5-7 show partial views of simulation results for cutting element assemblies.
Figure 6:
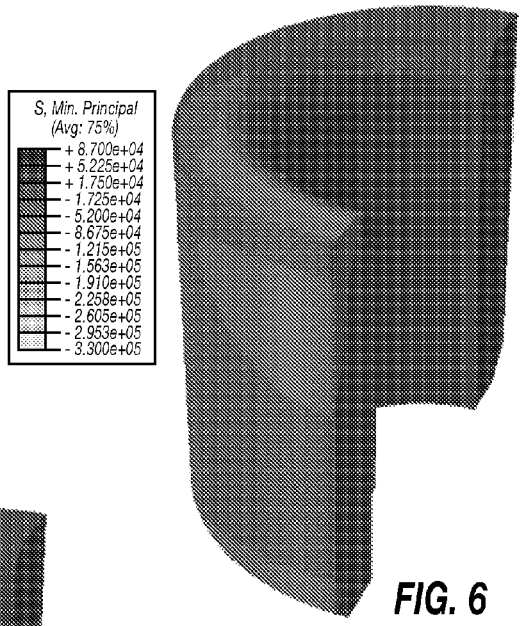
Figure 7:
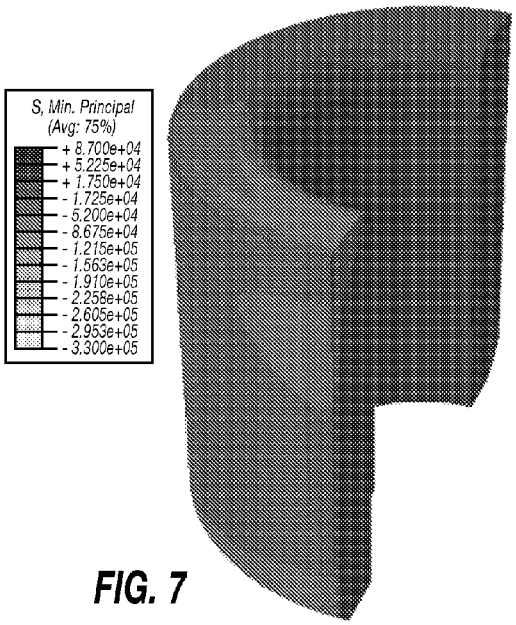

Simulations were performed using FEA to model performance of the sleeve portion and the cutting element portion of a cutting element assembly having different relationships between the cutting element outer diameter D and the sleeve radial length T. An FEA model used to model the performance of a sleeve portion of a cutting element assembly was based on the assumptions that the bottom end of the cutting element was fixed (such as to a cutter pocket formed in a drill bit), a uniform load equivalent to 2,000 lbf was applied to the cutting face of the cutting element, the rate of penetration ("ROP") was 40 ft/hr, the revolutions per minute was 100, and the depth of contact was 0.080 inches. FIG. 4 shows the FEA model setup for modeling the performance of different sleeve radial lengths in relation to the cutting element outer diameter D, wherein the uniform load of 2,000 lbf was applied to the cutting face 430 of the cutting element assembly 400, and the bottom end 405 of the cutting element assembly 400 is fixed.

Figure 8:
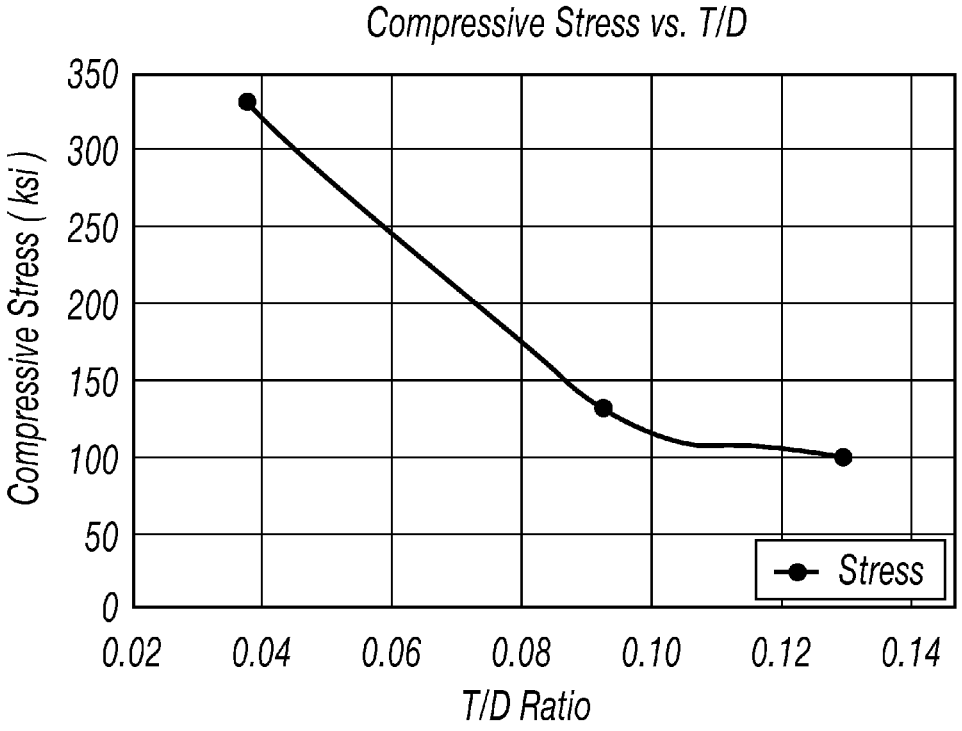
FIG. 8 shows a graph of simulation results for cutting element assemblies of the present disclosure.

FIGS. 5-8 illustrate simulation results using the model setup shown in FIG. 4 for various relationships between the cutting element outer diameter D and the sleeve radial length T (referred to as the T/D ratio) on the sleeve portion of the cutting element assembly. The T/D ratio tested in the model shown in FIG. 5 was 0.0378, which resulted in a compressive stress of 332.0 ksi on the sleeve portion of the cutting element assembly. The T/D ratio tested in the model shown in FIG. 6 was 0.0945, which resulted in a compressive stress of 131.4 ksi. The T/D ratio tested in the model shown in FIG. 7 was 0.1323, which resulted in a compressive stress of 98.7 ksi. FIG. 8 shows a graph comparing compressive stress to the T/D ratio of a cutting element.

Figure 9:
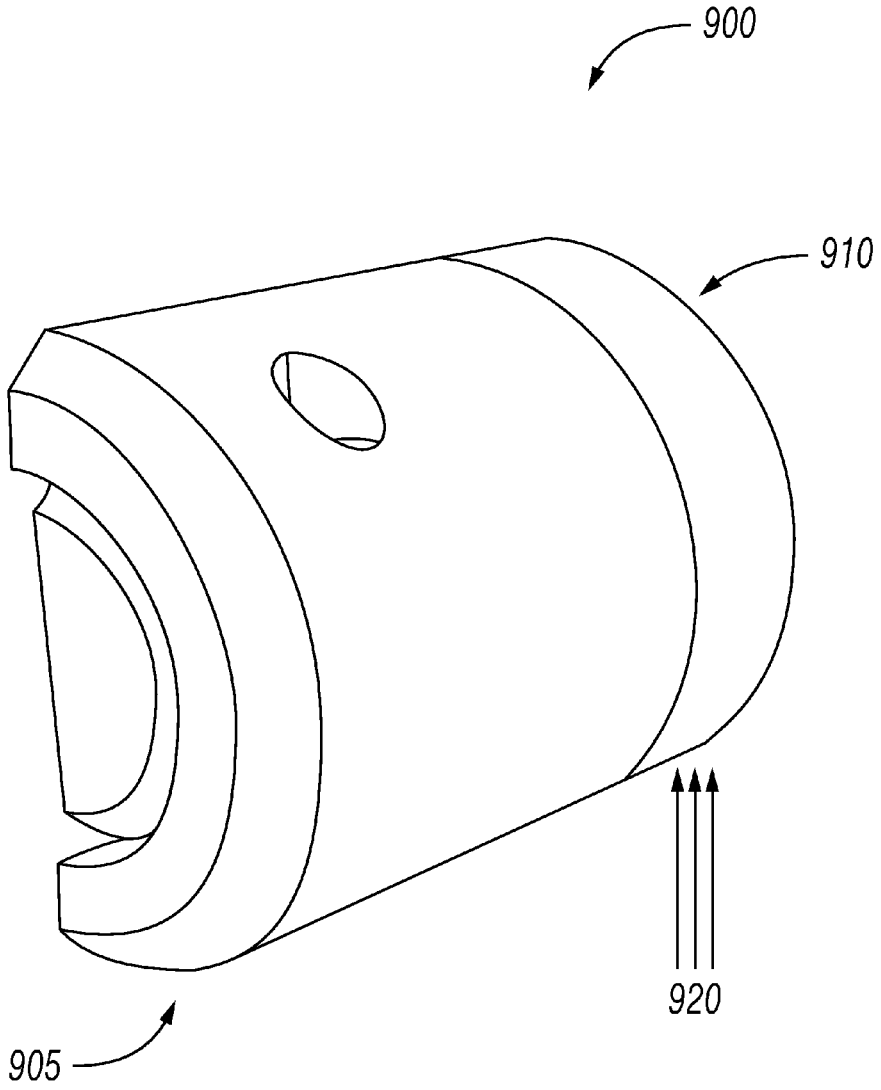
FIG. 9 shows a model setup for simulation of cutting element assemblies according to embodiments of the present disclosure.
Figure 10:
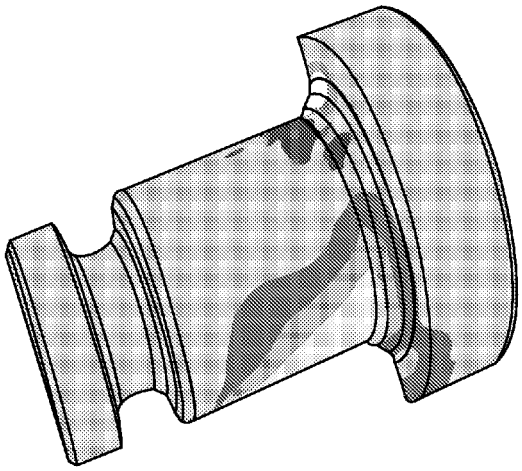
FIGS. 10-13 show perspective views of simulation results for cutting element assemblies according to embodiments of the present disclosure.
Figure 14:
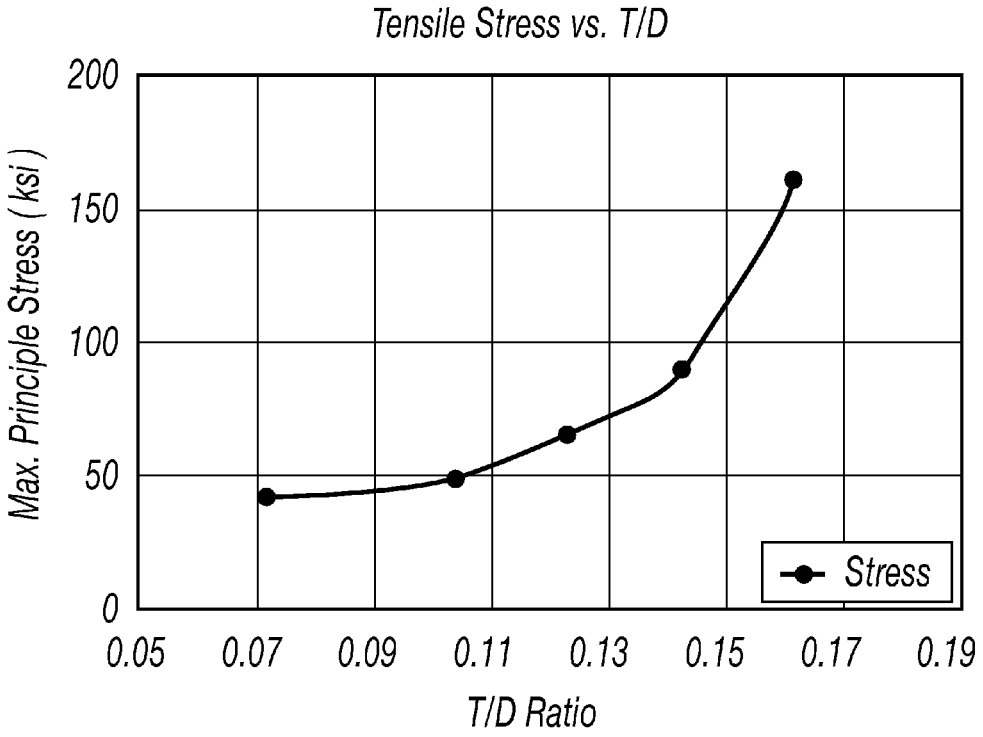
FIG. 14 shows a graph of simulation results for cutting element assemblies of the present disclosure.

Referring now to FIG. 9, an FEA model was designed to test the performance of the cutting element portion of a cutting element assembly having various T/D ratios under a shear loading of 1,100 lbf. The FEA model was based on the assumptions that the bottom end 905 of the cutting element assembly 900 was fixed (such as to a cutter pocket formed in a drill bit), and a shear load 920 of 1,100 lbf was applied to the cutting end 910 of the cutting element assembly 900. FIGS. 10-14 illustrate simulation results using the model setup shown in FIG. 9 for various relationships between the cutting element outer diameter D and the sleeve radial length T (referred to as the T/D ratio) on the cutting element portion of the cutting element assembly. The T/D ratio tested in the model shown in FIG. 10 was 0.104, which resulted in a maximum principal stress of 57.94 ksi on the cutting element. The T/D ratio tested in the model shown in FIG. 11 was 0.123, which resulted in a maximum principal stress of 66.59 ksi on the cutting element. The T/D ratio tested in the model shown in FIG. 12 was 0.142, which resulted in a maximum principal stress of 93.26 ksi on the cutting element. The T/D ratio tested in the model shown in FIG. 13 was 0.161, which resulted in a maximum principal stress of 191.2 ksi on the cutting element. FIG. 14 shows a graph comparing the maximum principal stress to the T/D ratio of a cutting element.

Simulation results from FEA analysis applying a frontal load of about 3,000 lbf and a shear load of about 667 lbf (calculated by 2,000 lbf*sin(20°), wherein 20° is the back-rake angle of the cutting element) may be used to calculate the strength of cutting element assemblies. For example, simulations of a frontal load applied to the cutting end of a cutting element show that a sleeve in a cutting element assembly may fail when the compressive load ultimate compressive strength is about 880 ksi. The predicted strength ($F_f$) in frontal load simulations may be calculated using the equation, $F_f = F*S_{UC}/S$, where $S_{UC}$ is the ultimate compressive strength, F is the load applied in the FEA simulations, and S is the stress calculated in the FEA simulations. Simulations of a shear load applied to the cutting end of a cutting element show that a cutting element in a cutting element assembly may fail when the tensile stress ultimate tensile strength is about 220 ksi. The predicted strength ($F_f$) in frontal load simulations may be calculated using the equation, $F_f=F*S_{UC}/S$, where $S_{UC}$ is the ultimate compressive strength, F is the load applied in the FEA simulations, and S is the stress calculated in the FEA simulations. Considering a three times safety factor, a 10,000 lbf frontal load and a 2,000 lbf shearing load may be set to be the limits.

Figure 15:
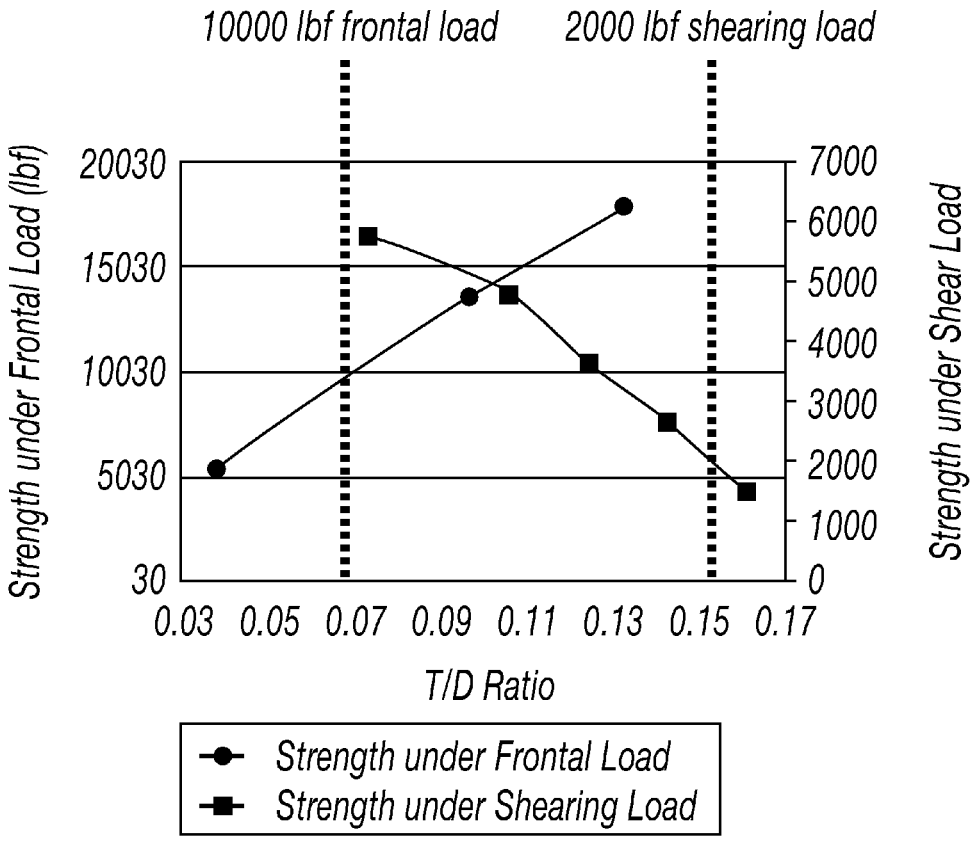
FIG. 15 shows a graph of simulation results for cutting element assemblies of the present disclosure.

FIG. 15 shows a graph comparing the FEA results for the strength of cutting element assemblies having different T/D ratios subjected to a frontal load and a shear load, as described above. According to embodiments of the present disclosure, cutting element assemblies may have a T/D ratio ranging from about 0.075 to about 0.11. According to some embodiments, cutting element assemblies may have a T/D ratio ranging from about 0.08 to about 0.10. For example, a cutting element assembly having a cutting element with a 13 mm outer diameter may have a T/D ratio ranging between 0.090 and 0.095, and a cutting element assembly having a cutting element with a 16 mm outer diameter may have a T/D ratio ranging between 0.085 and 0.090.

Outer Diameter (D) and Sleeve Thickness (d) and Radial Length (T)

According to some embodiments, the thickness d of the sleeve 22 may be selected based on the radial length T of the substantially planar surface of axial bearing surface 30 and the outer diameter D of the cutting element 24. In particular embodiments, d, D, and T may have the following relationship: $T \leq d \leq (1/3)D$. In other embodiments, d may have a lower limit of any of T, 1.25T, 1.5T, 2T, 2.5T, 3T, (1/25)D, (1/20)D, (1/15)D, (1/12)D, (1/10)D, (1/8)D, (1/7)D, or (1/6)D and an upper limit of any of 2T, 2.5T, 3T, 4T, 5T, 6T, (1/10)D, (1/8)D, (1/5)D, (1/4)D, or (1/3)D, where any upper limit can be used in combination with any lower limit. In one or more particular embodiments, d may have a lower limit of 0.15D, 0.17D, or 0.19D and an upper limit of 0.2D, 0.21D, 0.22D, or 0.23D. For example, for a cutter having a diameter of 13 mm (0.529 inches) and a T ranging from 0.025 to 0.050 inches, d may range, in particular embodiments, from 0.050 to 0.120 inches, and for a cutter having a diameter of 16 mm (0.625 inches) and a sleeve dimension T ranging from 0.030 to 0.070 inches, d may range from 0.060 to 0.150 inches. However, lesser or greater values of d may be suitable, in accordance with the mentioned relationship.

Figure 16:
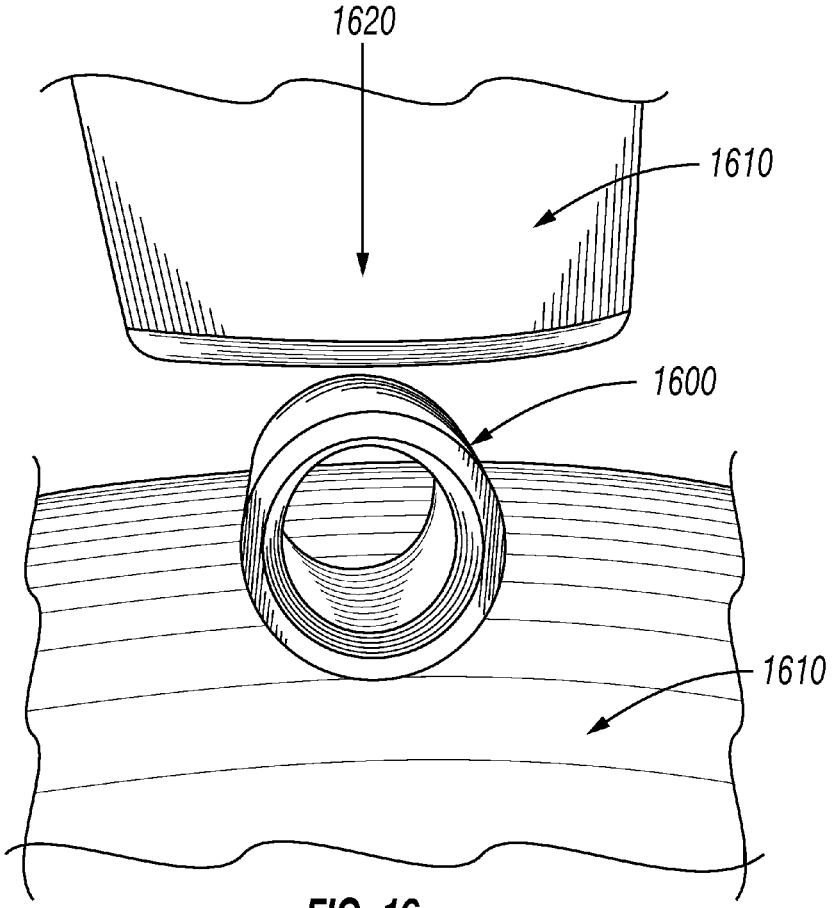
FIG. 16 shows a test setup for testing the crush strength of sleeves according to embodiments of the present disclosure.
Figure 17:
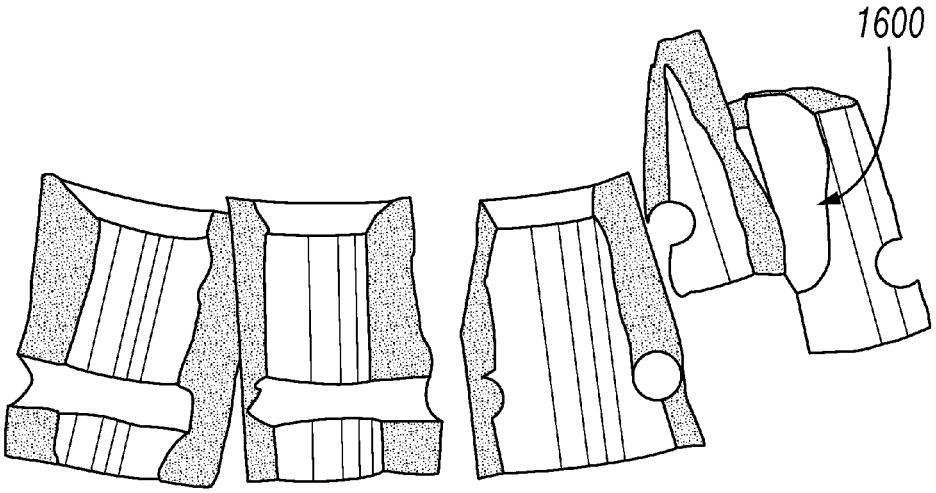
FIG. 17 shows sleeves according to embodiments of the present disclosure.
Figure 18:
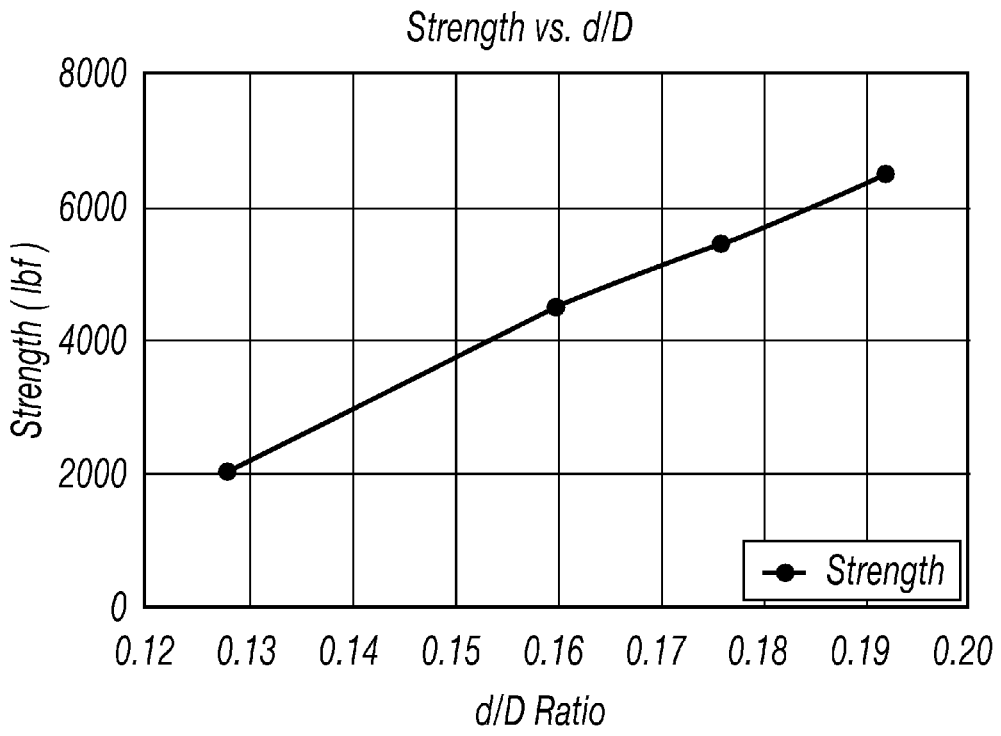
FIG. 18 shows a graph of results for sleeve testing according to embodiments of the present disclosure.
Figure 19:
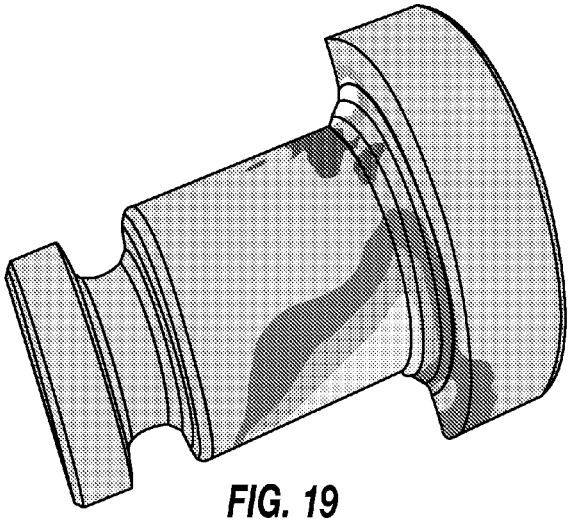
FIGS. 19-22 show perspective views of simulation results for cutting element assemblies according to embodiments of the present disclosure.
Figure 20:
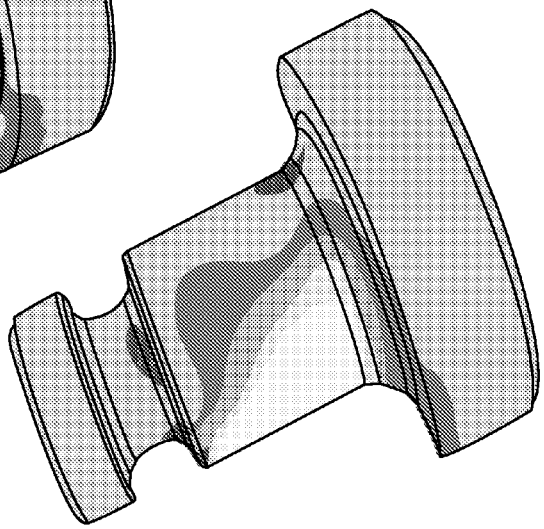
Figure 21:
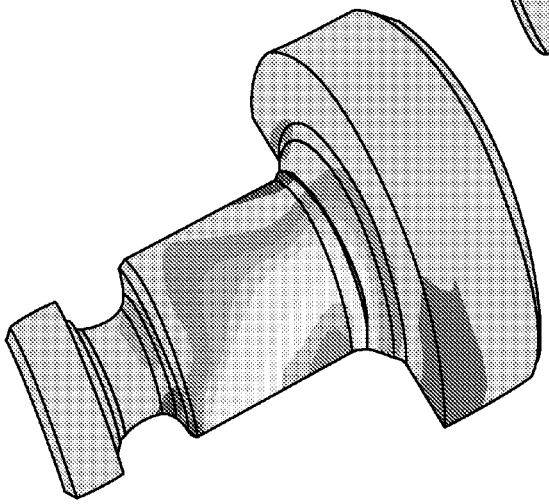
Figure 22:
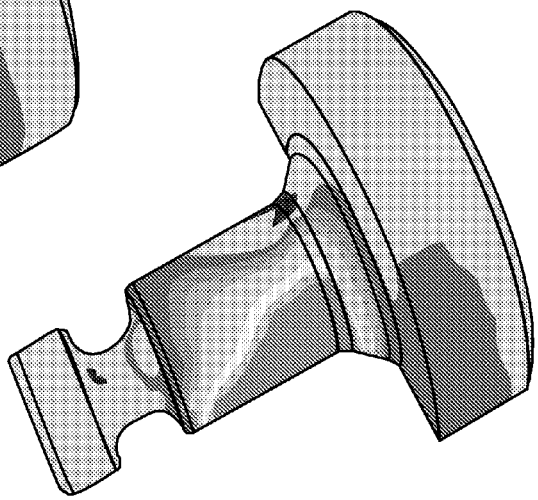

In some embodiments having a small sleeve wall thickness (d), the sleeve may be weaker under a crush loading condition and a shear loading condition. In some embodiments having a large sleeve wall thickness (d), the diameter of the cutting element shank may be relatively smaller, thereby resulting in a lower cutting element strength under shear loading conditions. FIG. 16 shows an example of a crush testing setup that may be used to test the strength of various sleeve wall thicknesses (d). As shown, a sleeve 1600 may be positioned along its axis between an anvil 1610. The anvil 1610 applies a crush loading 1620 to crush the sleeve 1600. FIG. 17 shows failed samples of sleeves 1600 subjected to the crush testing setup shown in FIG. 16, and FIG. 18 shows a graph of the results. As shown in FIG. 18, the strength of the sleeve increases as the ratio of the sleeve wall thickness (d) to the outer diameter (D) increases.

Figure 23:
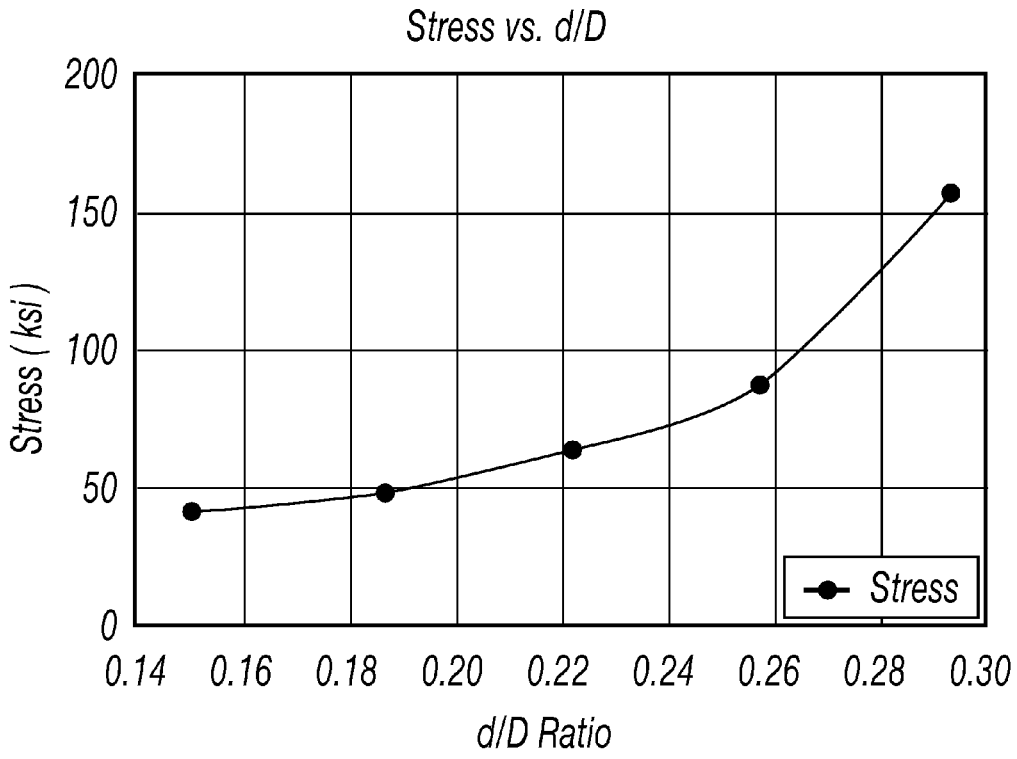
FIG. 23 shows a graph of simulation results for cutting element assemblies of the present disclosure.

FEA analysis was conducted to test the performance of the cutting element portion of a cutting element assembly having various d/D ratios under a shear loading of 1,100 lbf. The FEA model setup described above (and shown in FIG. 9) was used, where the bottom end of the cutting element assembly was fixed (such as to a cutter pocket formed in a drill bit), and the shear loading of 1,100 lbf was applied to the cutting end of the cutting element assembly. FIGS. 19-22 illustrate simulation results of the FEA analysis for various relationships between the cutting element outer diameter D and the sleeve wall thickness d (referred to as the d/D ratio) on the cutting element portion of the cutting element assembly. The d/D ratio tested in the model shown in FIG. 19 was 0.189, which resulted in a maximum principal stress of 57.94 ksi on the cutting element. The d/D ratio tested in the model shown in FIG. 20 was 0.227, which resulted in a maximum principal stress of 66.59 ksi on the cutting element. The d/D ratio tested in the model shown in FIG. 21 was 0.265, which resulted in a maximum principal stress of 93.26 ksi on the cutting element. The d/D ratio tested in the model shown in FIG. 22 was 0.302, which resulted in a maximum principal stress of 191.2 ksi on the cutting element. FIG. 23 shows a graph comparing the maximum principal stress to the d/D ratio of a cutting element.

Figure 24:
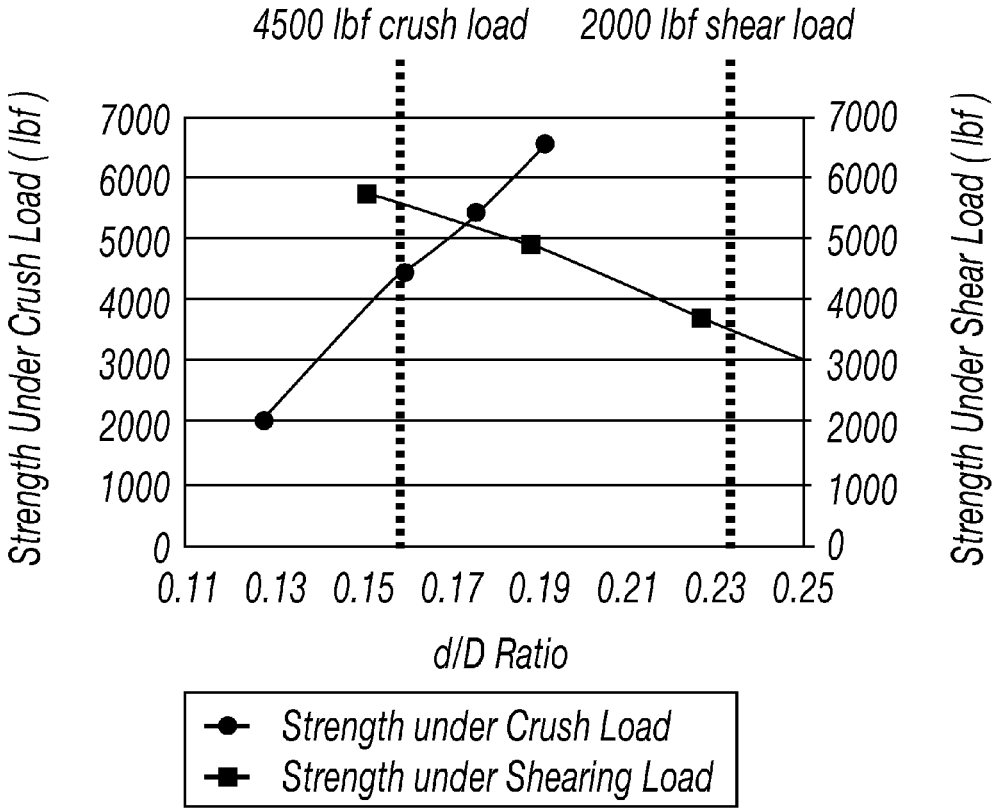
FIG. 24 shows a graph of results for cutting element assembly testing.

FIG. 24 shows a graph comparing the results for the strength testing of cutting element assemblies having different d/D ratios subjected to a crush load (FIGS. 16-18) and a shear load (FIGS. 19-23), as described above. According to embodiments of the present disclosure, cutting element assemblies may have a d/D ratio ranging from about 0.19 to about 0.22. According to some embodiments, cutting element assemblies may have a d/D ratio ranging from about 0.20 to about 0.21. For example, a cutting element assembly having a cutting element with a 13 mm outer diameter may have a d/D ratio ranging between 0.205 and 0.210, and a cutting element assembly having a cutting element with a 16 mm outer diameter may have a d/D ratio ranging between 0.195 and 0.205.

Axial Extension (U) and Ultra Hard Material Layer Thickness (S)

According to some embodiments, the substrate 26 may have an upper portion **26*b* extending axially above the spindle 26*a*/sleeve 22 from the axial bearing surface 30 to interface with the ultrahard material layer 28. The height of the axial extension of the carbide substrate 26 from the axial bearing surface 30 to the ultrahard material layer 28 may be referenced as axial extension U. Further, in the illustrated embodiment, ultrahard material layer 28** may have a thickness S. In particular embodiments, U and S may have the following relationship: $U/S \geq 0.5$. That is, U is at least one-half the thickness S of the ultrahard material layer. In one or more embodiments, U/S may be at least 0.75, 0.9 or 0.95 and up to 1.1, 1.2, 1.25, or 1.3, where any lower limit can be used with any upper limit.

According to some embodiments of the present disclosure, thermal residual stress from the cutting element manufacturing may be higher when the substrate thickness value U is low. Further, a cutting element assembly having a low substrate thickness value U may be more vulnerable particularly at the transition zone under frontal impact.

Figure 36:
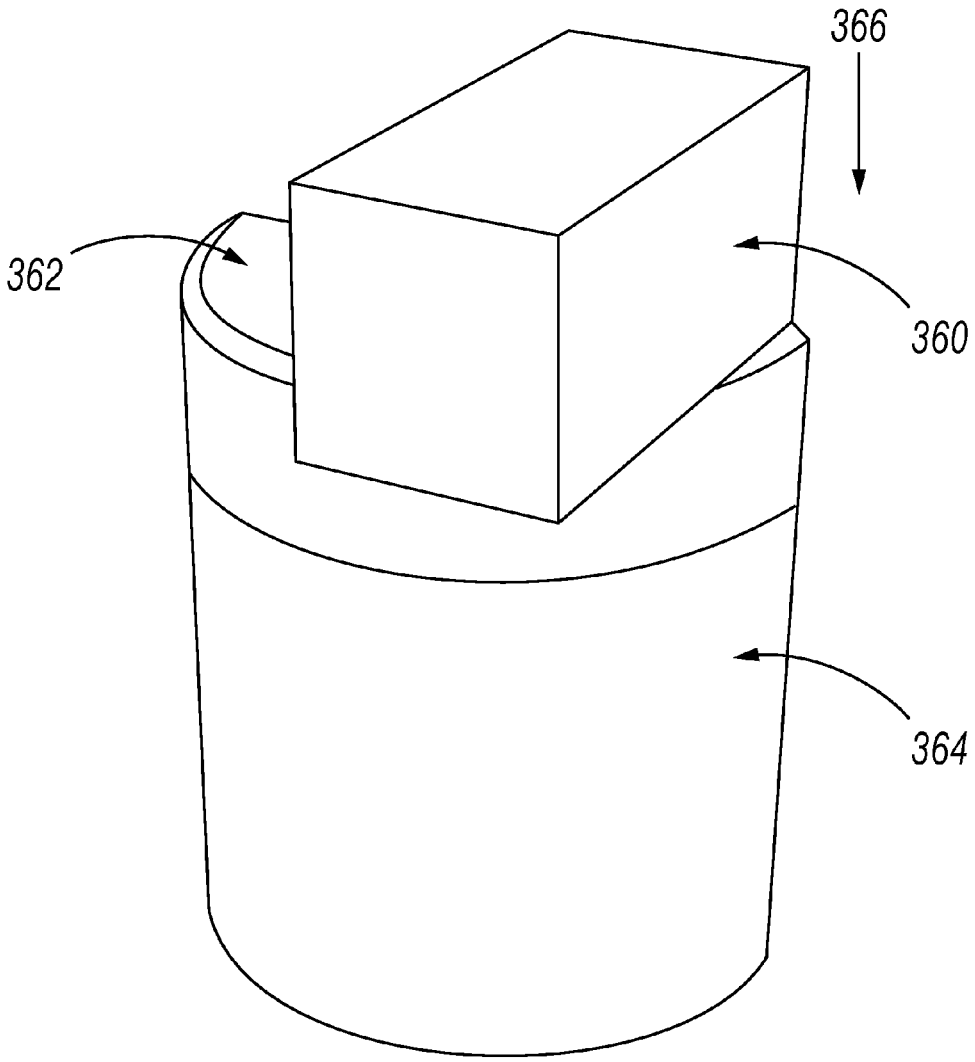
FIG. 36 shows a model setup for simulation of cutting element assemblies according to embodiments of the present disclosure.
Figure 37:
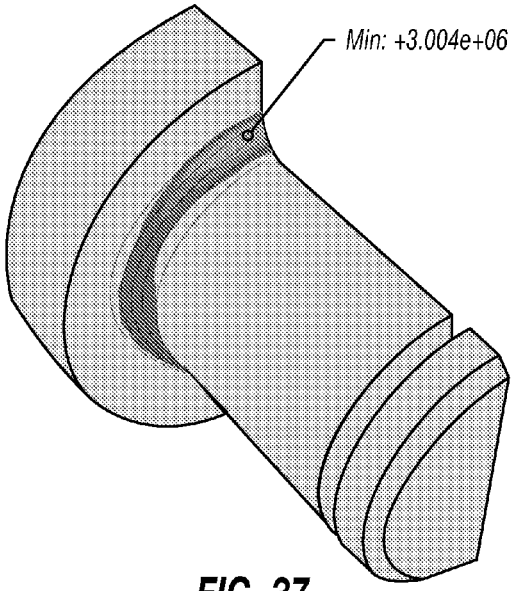
FIG. 37-39 show perspective views of simulation results for cutting element assemblies according to embodiments of the present disclosure.
Figure 38:
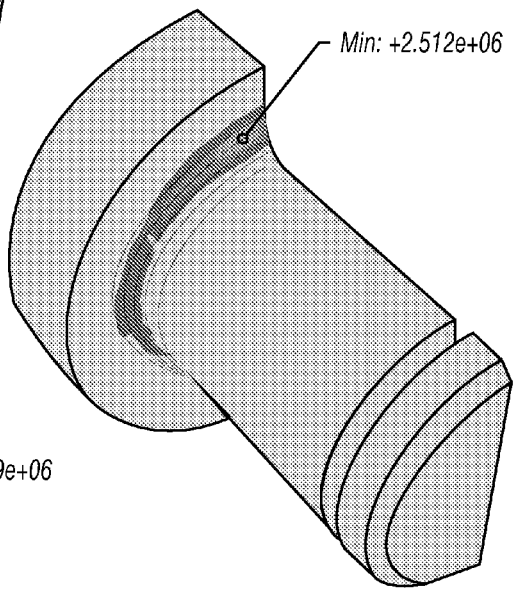
Figure 39:
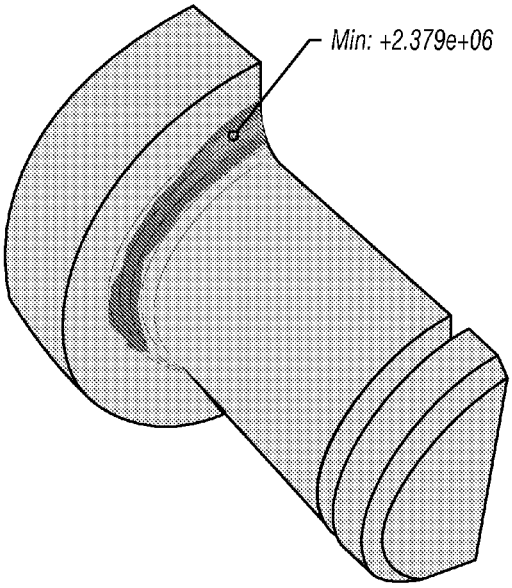
Figure 40:
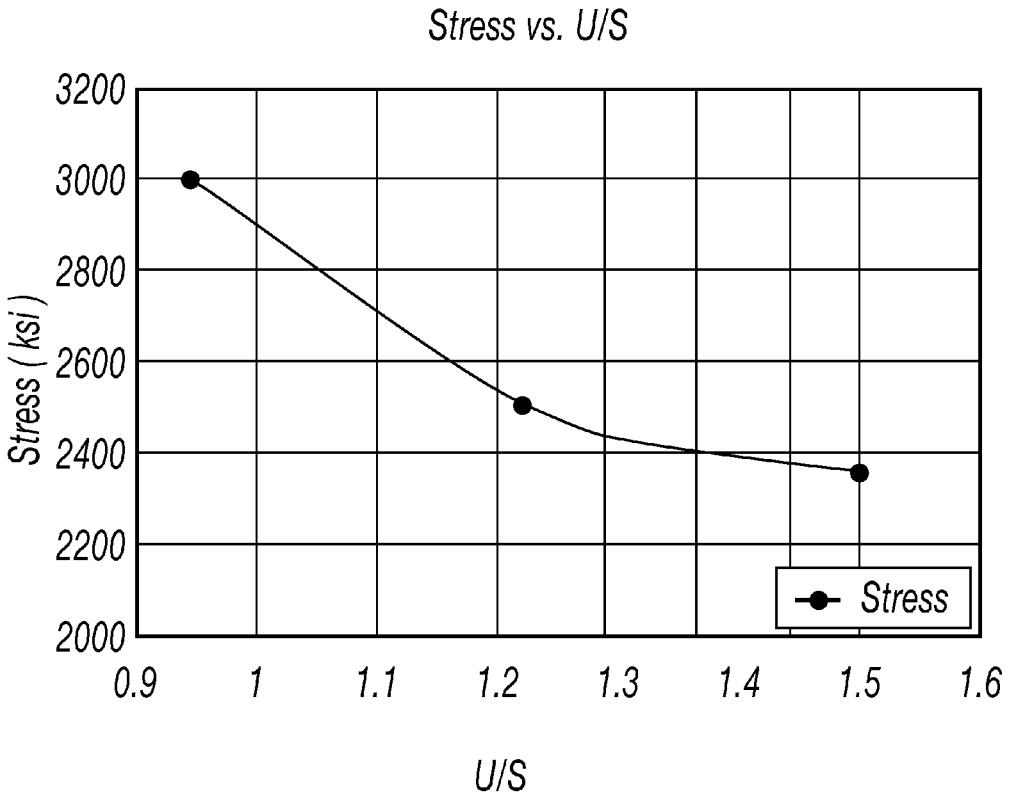
FIG. 40 shows a graph of simulation results for cutting element assemblies of the present disclosure.

Referring now to FIG. 36, a setup for a frontal impact simulation is shown. In the setup, a block 360 is impacted onto a cutting face 362 of a cutting element assembly 364. Particularly, the block 360 is simulated at a velocity 366 to the cutting face 362 under the parameters of a depth of compression of 0.20 inches and energy of 30 Joules. FIGS. 37-39 show simulation results from the model setup shown in FIG. 36. As shown in FIG. 37, a stress of 3,004 ksi resulted from the frontal impact simulation on a cutting element 370 having a U/S ratio of 0.94. As shown in FIG. 38, a stress of 2,512 ksi resulted from a frontal impact simulation on a cutting element 380 having a U/S ratio of 1.22. As shown in FIG. 39, a stress of 2,379 ksi resulted from a frontal impact simulation on a cutting element 390 having a U/S ratio of 1.50. FIG. 40 shows a graph comparing the FEA results of the frontal impact simulations on cutting elements with various U/S ratios.

Figure 41:
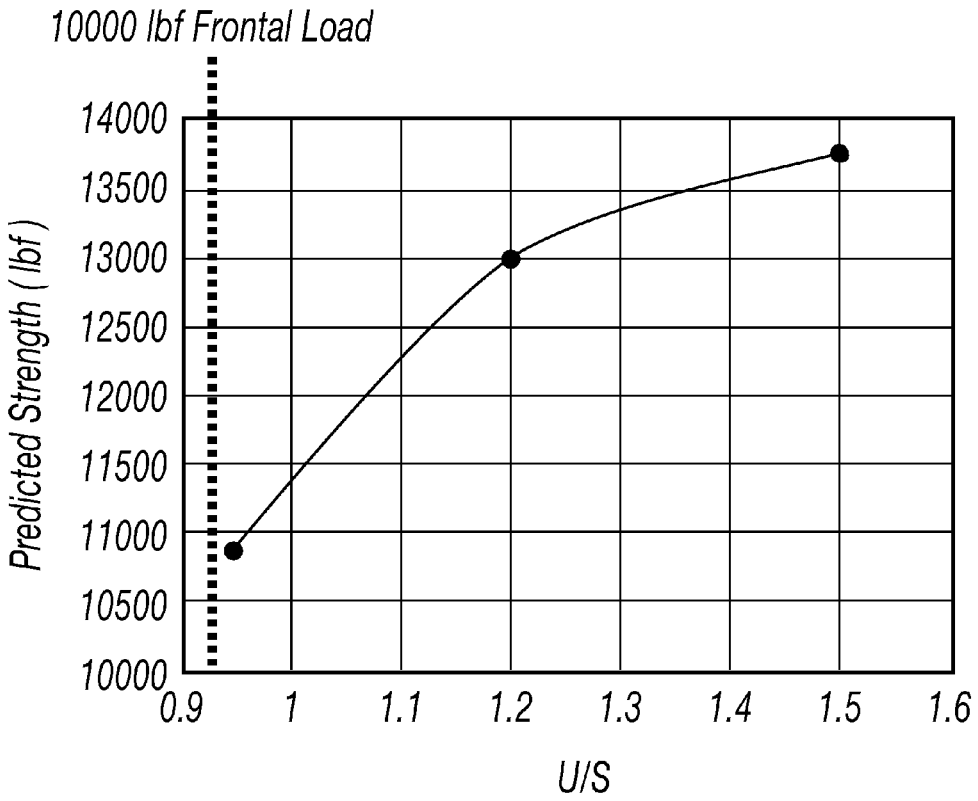
FIG. 41 shows a graph of simulation results for cutting element assemblies of the present disclosure.

Lab testing was also conducted on cutting element assemblies having a U/S ratio of 1.22, which showed failure at about 13,000 lbf. From simulations and lab testing, the predicted strength of a cutting element assembly may be calculated based on the equation $F_S=F*S_{1.22}/S$, where $S_{1.22}$ is the stress simulated at U/S=1.22 in FEA simulations, F is the load from testing, and S is the stress simulated. FIG. 41 shows a graph comparing the predicted strength of cutting element assemblies having various U/S ratios. According to embodiments of the present disclosure, a cutting element assembly may have a U/S ratio ranging from about 0.9 to about 1.3. For example, a 13 mm diameter cutting element assembly may have a U/S ratio ranging from about 0.94 to about 0.95, and a 16 mm diameter cutting element assembly may have a U/S ratio ranging from about 1.22 to about 1.23.

Axial Extension (U), Ultra Hard Material Layer Thickness (S) and Cutter Assembly Length (L)

It may also be desirable to consider U in the context of both S and the total length of the cutter assembly, shown as L in FIG. 2. Thus, in some embodiments, U, S, and L may have the following relationship: U+S≤¾L or in a more particular embodiment, U+S≤½L or U+S≤(2/5)L or U+S≤(3/10)L. Further, it is also within the scope of the present disclosure that the cutting element 24 may be a single piece of material, such as diamond or other ultrahard materials, such as polycrystalline cubic boron nitride. In such an instance, the total extension of the element (equivalent to U+S) above the axial bearing surface 30 may be considered in relation to L, and may be no more than 1.0L, 0.75L, 0.5L, 0.3L, 0.2L, and 0.1L in various embodiments.

In embodiments having a high cutting element table thickness (U+S), the sleeve may be weakened by shear loading applied to the cutting element table. Further, in embodiments having a high cutting element table thickness and a small spindle length, the cutting element assembly may be relatively unstable under dynamic motion and may thus result in a shorter fatigue life.

Figure 30:
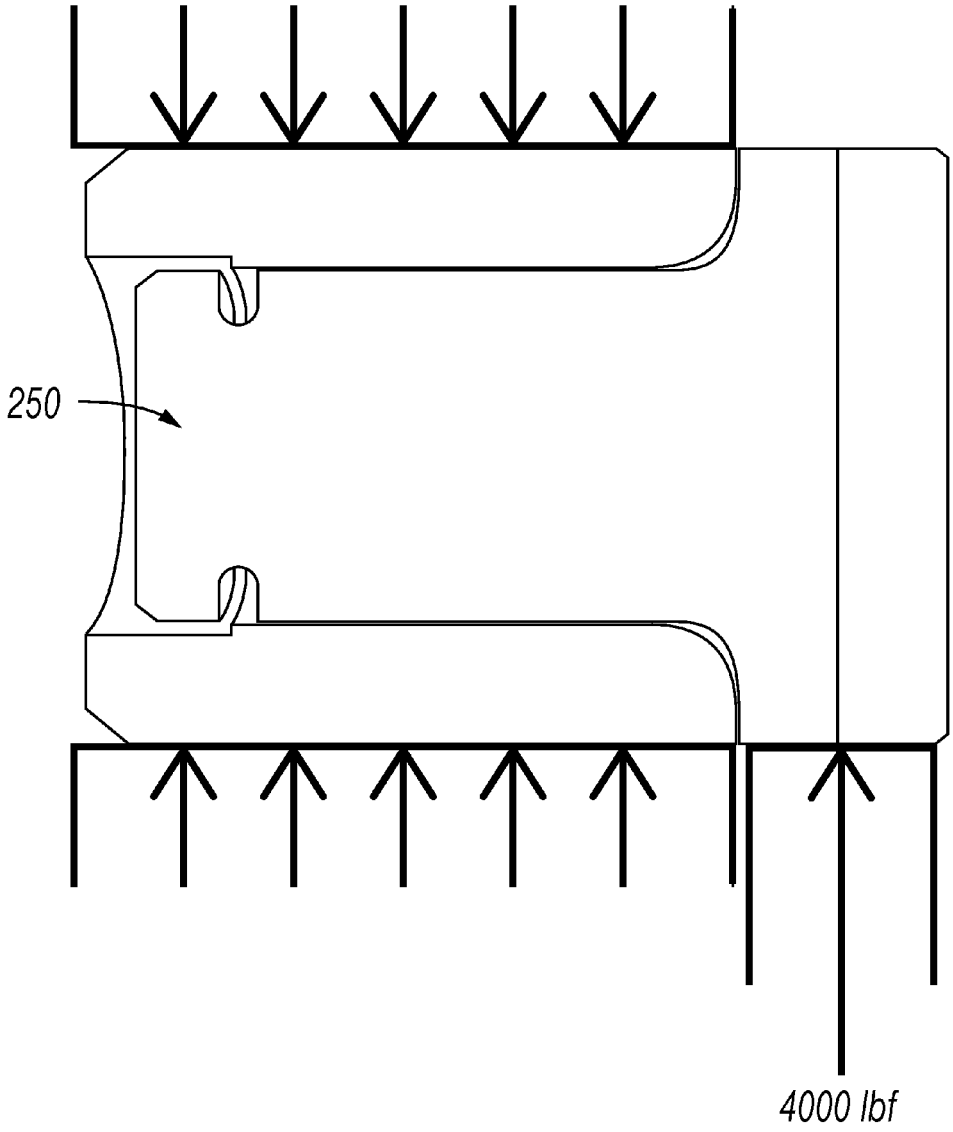
FIG. 30 shows a model setup for simulation of cutting element assemblies according to embodiments of the present disclosure.
Figure 31:
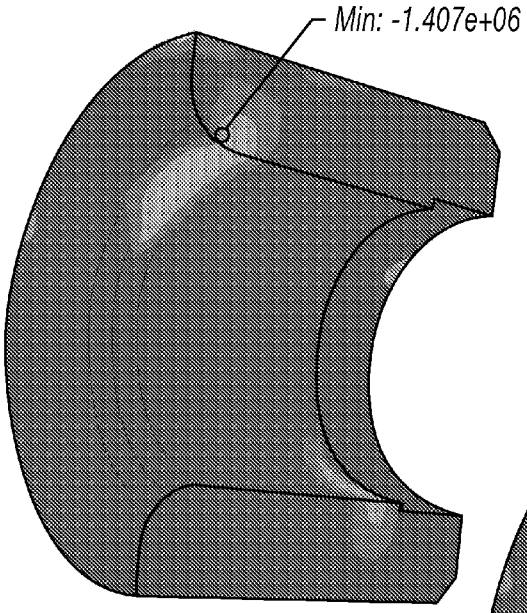
FIGS. 31-33 show partial views of simulation results of sleeves.
Figure 32:
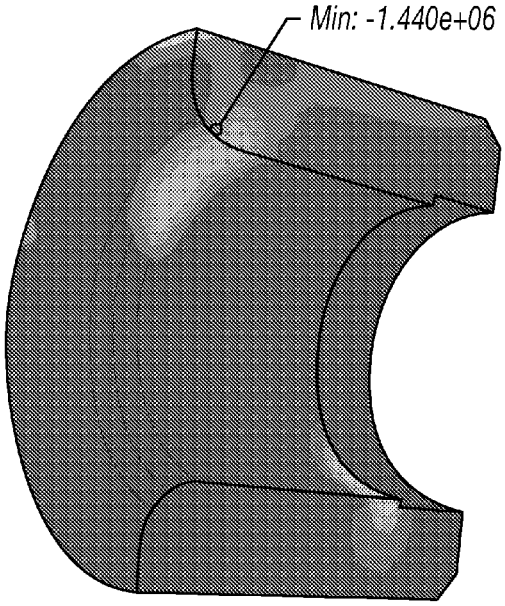
Figure 33:
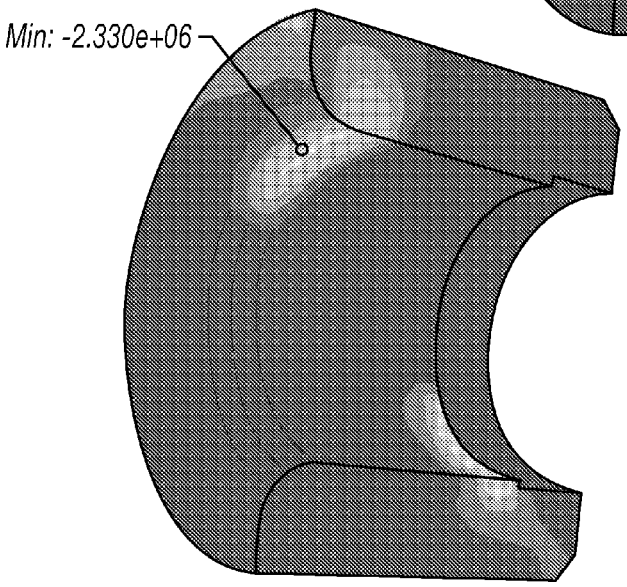
Figure 34:
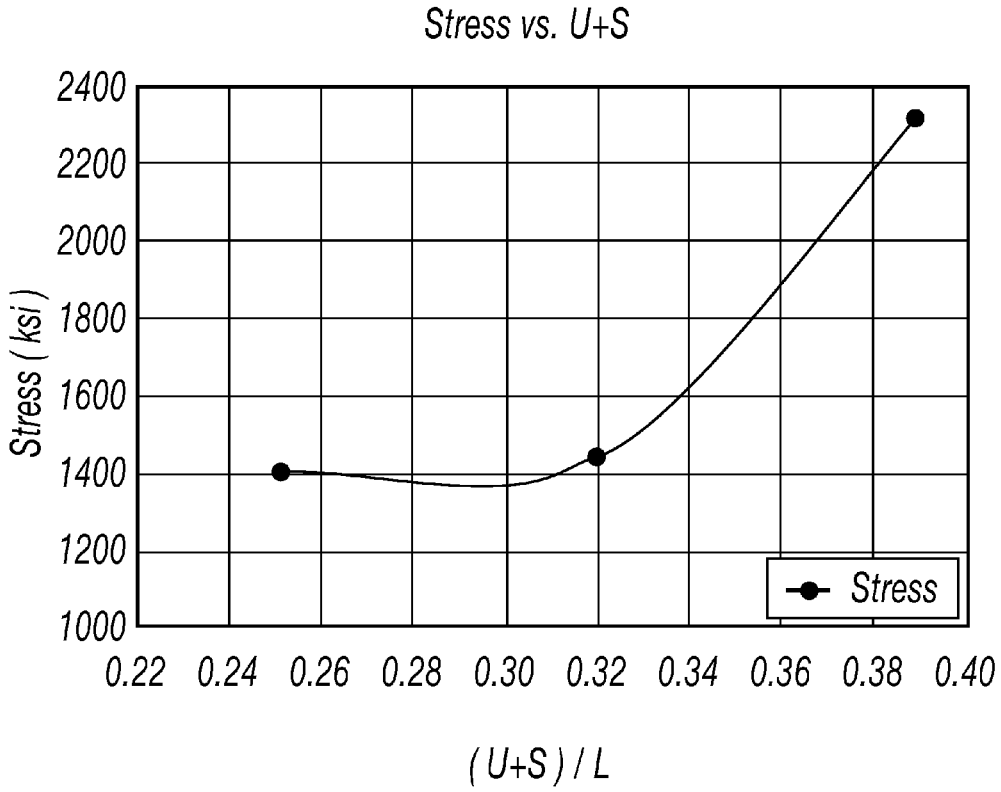
FIG. 34 shows a graph of simulation results for cutting element assemblies of the present disclosure.

FIG. 30 shows an FEA model designed to test the performance of a cutting element 250 under a shear loading of 4,000 lbf from a bottom radial position to analyze the relationship between the thickness of U+S to the length of the cutting element spindle. FIGS. 31-33 show simulation results for stress in the sleeve of a cutting element assembly using the model setup shown in FIG. 30. As shown in FIG. 31, a cutting element assembly having a U+S thickness equal to 0.25L (¼$^{th}$ of the length of the cutting element assembly) results in a minimum principle stress of 1407 ksi when subjected to the shear loading of 4,000 lbf. In FIG. 32, a cutting element assembly having a U+S thickness equal to 0.32L results in a minimum principle stress of 1440 ksi when subjected to the shear loading of 4,000 lbf. In FIG. 33, a cutting element assembly having a U+S thickness equal to 0.39L results in a minimum principle stress of 2330 ksi when subjected to the shear loading of 4,000 lbf. FIG. 34 shows a graph comparing the minimum principal stress to the (U+S)/L ratio of a cutting element.

Figure 35:
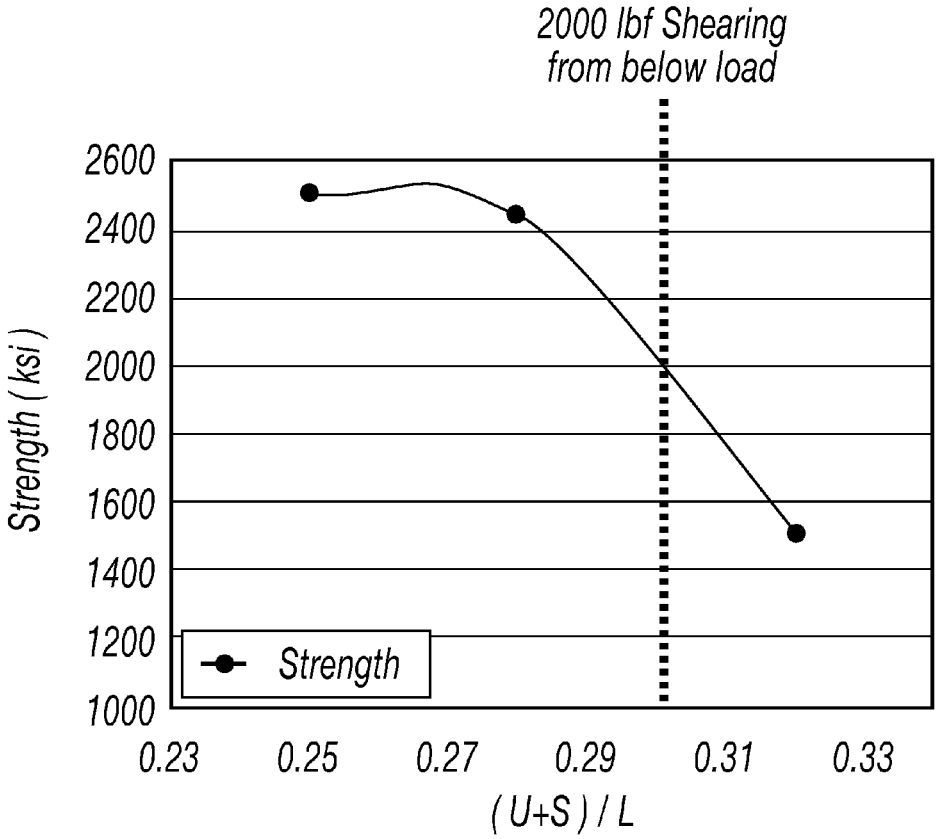
FIG. 35 shows a graph of simulation results for cutting element assemblies of the present disclosure.

Simulation results from FEA analysis applying a shear load may be used to calculate the strength of cutting element assemblies. For example, simulations of a shear load applied to the cutting end of a cutting element show that a sleeve in a cutting element assembly may fail when the compressive load ultimate compressive strength is about 880 ksi. The predicted strength ($F_S$) in shear load simulations may be calculated using the equation, $F_S=F*S_{tr}/S$, where $S_{tr}$ is the ultimate tensile strength, F is the load applied in the FEA simulations, and S is the stress calculated in the FEA simulations. For example, in simulations with a shearing load of 666.7 lbf, a predicted strength limit of 2,000 lbf may be set considering the 3 times safety factor. Additionally, a larger U+S thickness may lead to a shorter guide of the sleeve, which may decrease the stability of the system and jeopardize the cutting element assembly fatigue life. FIG. 35 shows a graph comparing the predicted strength of a cutting element assembly to the (U+S)/L ratio of the cutting element assembly. According to embodiments of the present disclosure, the (U+S)/L of a cutting element assembly may range from about 0.26 to about 0.30. For example, a cutting element assembly having a 13 mm diameter may have a (U+S)/L ratio ranging from about 0.27 to about 0.28, and a cutting element assembly having a 16 mm diameter may have a (U+S)/L ratio ranging from about 0.28 to about 0.29.

Upper Outer Diameter (J) and Lower Outer Diameter (j)

Additionally, as shown in FIG. 2, in some embodiments, the spindle **26*b* may have two outer diameters, an upper outer diameter J, which is located axially above (in the direction of the cutting face) the retention cavity 32 located on a side surface of the spindle 26*b* and a lower outer diameter j, located axially below the retention cavity. In some embodiments, the lower outer diameter j may be equal to or less than the upper outer diameter J. In some embodiment, the differential may be up to 0.07 inches or up to 0.05, 0.04, 0.03 or 0.02 inches in yet other embodiments. Further, in one or more embodiments, sufficient distance between j and J may be selected to avoid contact between the spindle 26*a* axially below the retention cavity 32 and the sleeve 22. However, it is also envisioned that j and J can be equal and contact may still be avoided by altering the axial dimensions of the cutting element rearward of the retention cavity. For example, the axial extent p of cutting element 24 rearward of the retention cavity 32** may be at least 0.1 inches or 0.12 inches in one or more embodiments, and less than 0.2 or 0.25 inches in yet other embodiments.

In embodiments having a small lower outer diameter j, the retention mechanism may be weakened, as the lower spindle may not have enough length to hold the retention device. However, in embodiments having a large lower outer diameter j, the lower spindle portion may contact the sleeve under shear loading, which may result in a stress concentration on the groove with the smallest diameter that will further reduce the strength of the cutting element. To avoid contact between the lower spindle and sleeve under shear loading, the inner diameter of the sleeve may be partially increased.

Figure 25:
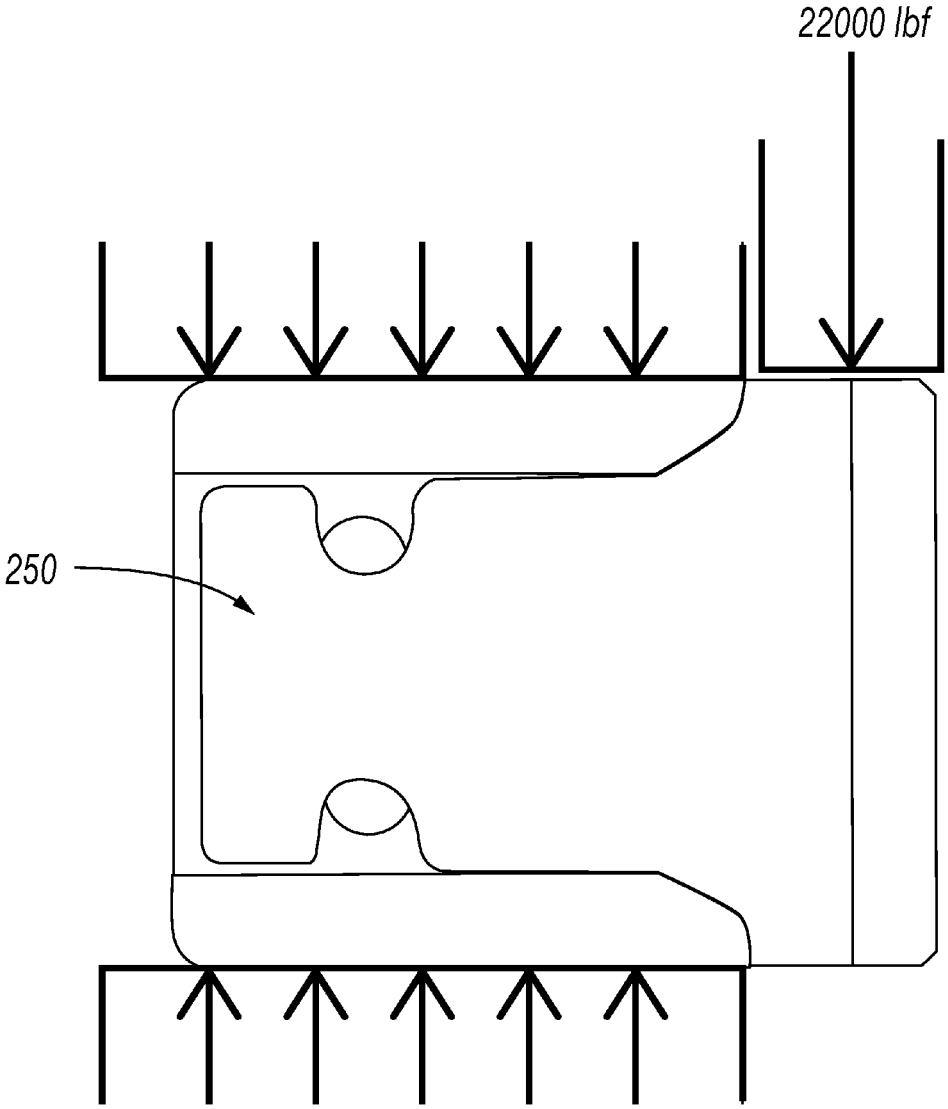
FIG. 25 shows a model setup for simulation of cutting element assemblies according to embodiments of the present disclosure.
Figure 26:
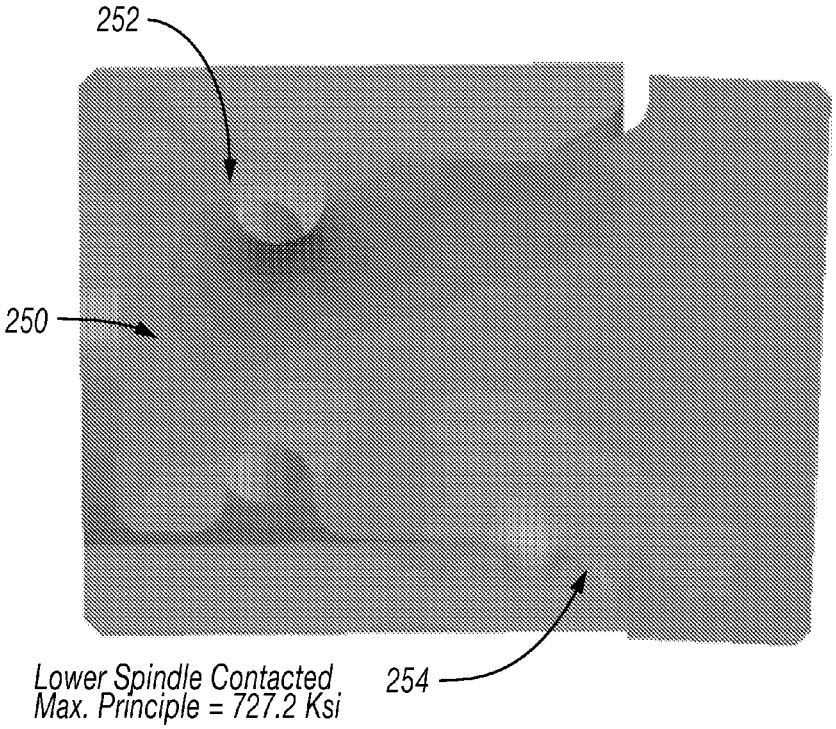
FIGS. 26 and 27 show simulation results for cutting element assemblies according to embodiments of the present disclosure.
Figure 27:
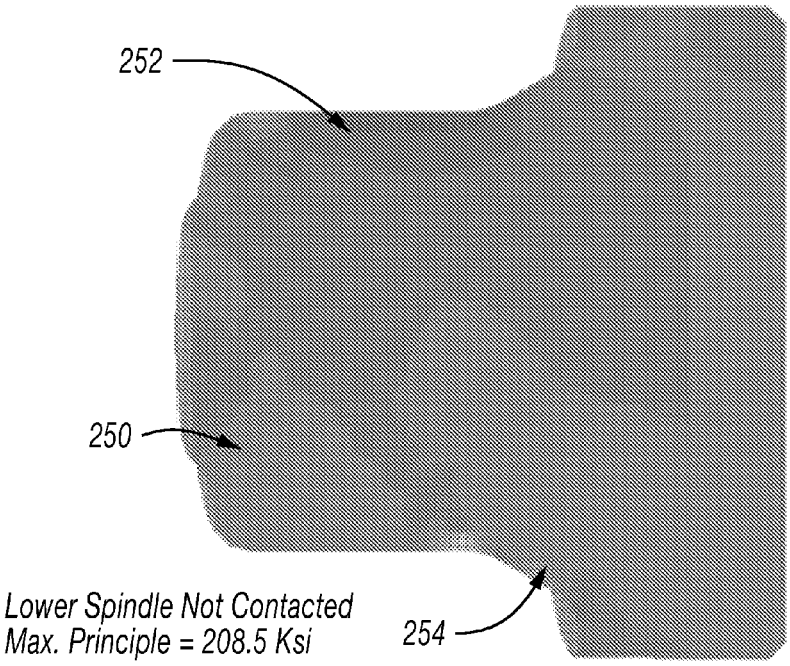
Figure 28:
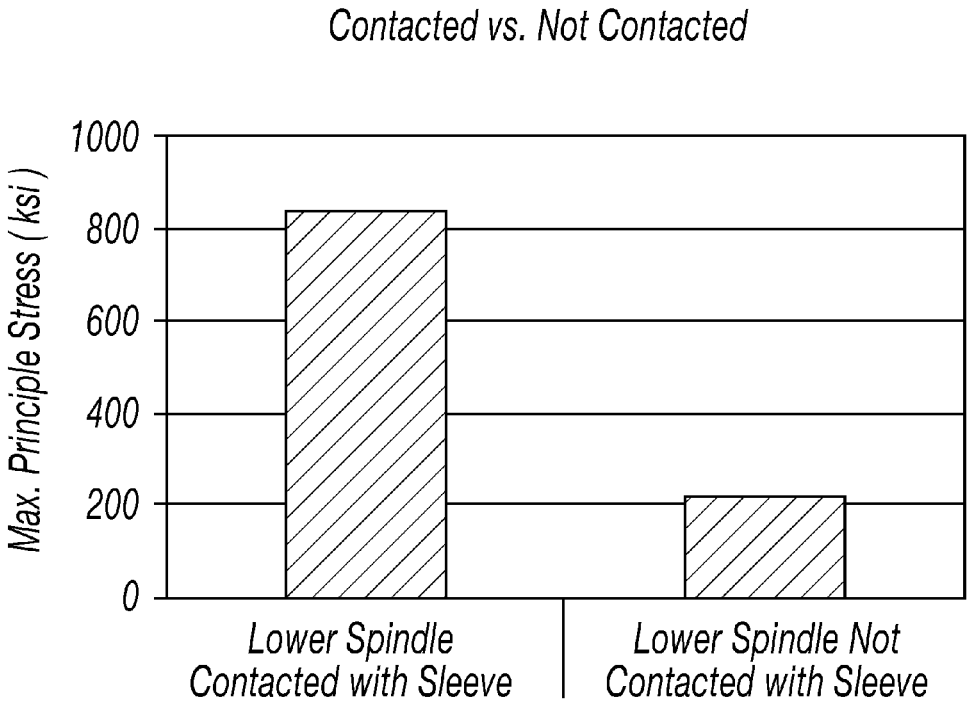
FIG. 28 shows a graph of results for cutting element assembly testing.

Referring now to FIG. 25, an FEA model was designed to test the performance of a cutting element 250 having various spindle diameters under a shear loading of 22,000 lbf from a top radial position. FIGS. 26 and 27 show simulation results using the model setup shown in FIG. 25, which show higher concentrations of stress at the side of the cutting element spindle 252 closest to the shear load and a higher concentration of stress at the side of the axial bearing surface 254 opposite from the shear load. FIG. 28 shows a graph comparing the maximum principle stress of cutting elements in embodiments where the lower spindle contacts the sleeve during application of a shear load to embodiments wherein the lower spindle does not contact the sleeve during application of a shear load. As shown, the maximum principle stress on the spindle and sleeve contacted model is about 4 times higher than that on the spindle and sleeve not contacted model under 22,000 lbf loading.

Figure 29:
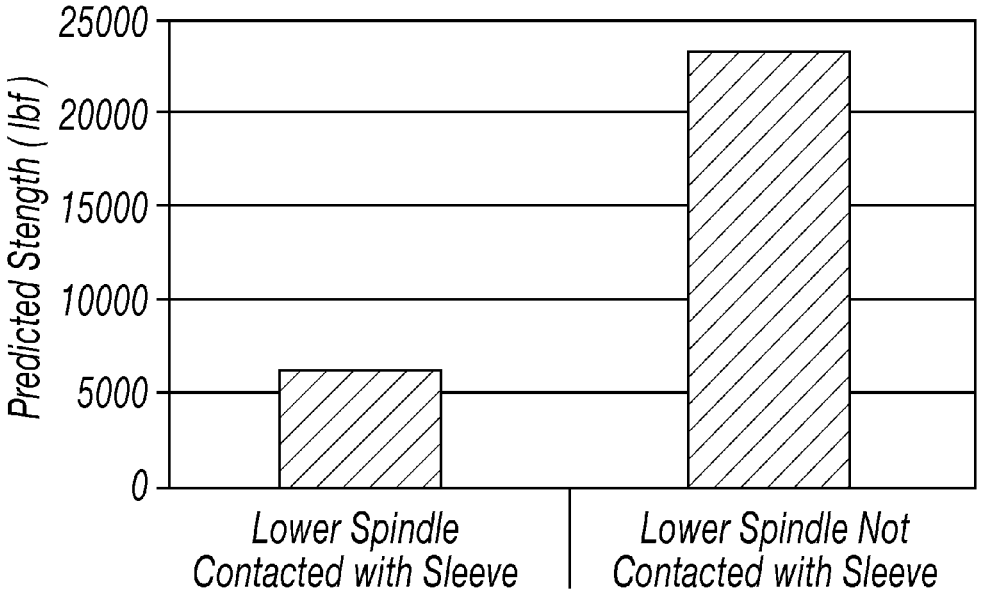
FIG. 29 shows a graph of results for cutting element assembly testing.

FIG. 29 shows a graph comparing the predicted strength of cutting elements in embodiments where the lower spindle contacts the sleeve during application of a shear load to embodiments wherein the lower spindle does not contact the sleeve during application of a shear load. The predicted strength ($F_S$) is calculated using the equation, $F_S=F*S_{UT}/S$, where $S_{UT}$ is the ultimate tensile strength and equal to 220 ksi, F is the load applied in the FEA simulations, and S is the stress calculated in the FEA simulations. Considering a three times safety factor, a 9,000 lbf shearing load may be set to be the limit.

In yet another aspect, as shown in FIG. 2, in some embodiments, the distance or gap g between a back face of the cutting element 24 and a back face of the sleeve 22 may be limited. In some embodiments, the gap g may be less than or equal to 0.040 inches, less than 0.030 inches, less than 0.020 inches, less than 0.010 inches, or less than 0.005 inches or even no gap is present, i.e., the back face of the cutting element 24 is at substantially the same axial position relative to the sleeve 22. However, it may also be desirable to include at least some gap, of at least 0.003 inches. For example, according to some embodiments of the present disclosure, a 13 mm cutting element having a lower outer diameter of a spindle equal to the upper outer diameter of the spindle may have a gap ranging between 0.01 and 0.02 inches. According to some embodiments of the present disclosure, a 16 mm cutting element having a lower outer diameter of a spindle equal to the upper outer diameter of the spindle may have a gap ranging between 0.01 and 0.02 inches. The inventors of the application have advantageously found that controlling the gap between the cutting element and the sleeve at the back face may limit the amount of wear that can occur on the axial bearing surface 30 of the sleeve. If any wear does occur on the sleeve, the amount of wear may be limited to the amount of gap present. Once the cutting element wears the sleeve to an amount equal to the gap, the load from the cutting on the sleeve may be transferred to a back wall of a cutter pocket in which the cutter assembly is held, limiting movement of the cutting element and further wear of the sleeve. Further, to avoid contact between the lower spindle and sleeve under shear loading, a gap of greater than or equal to 0.003 inches may be provided between the back face of the cutting element and a back face of the sleeve in a cutting element assembly.

Radius (R) and Diameter (D)

Referring again to FIG. 2, the cutting element 24 may have a radius transition R from the outer surface of the lower portion 26*a* of the cutting element to the axial bearing surface 30 at the upper portion 26*b* of the cutting element 24. According to some embodiments, the radius may range from less than or equal to 0.005 inches to greater than or equal to $\frac{1}{4}^{th}$ the diameter D of the cutting element 24.

Figure 42:
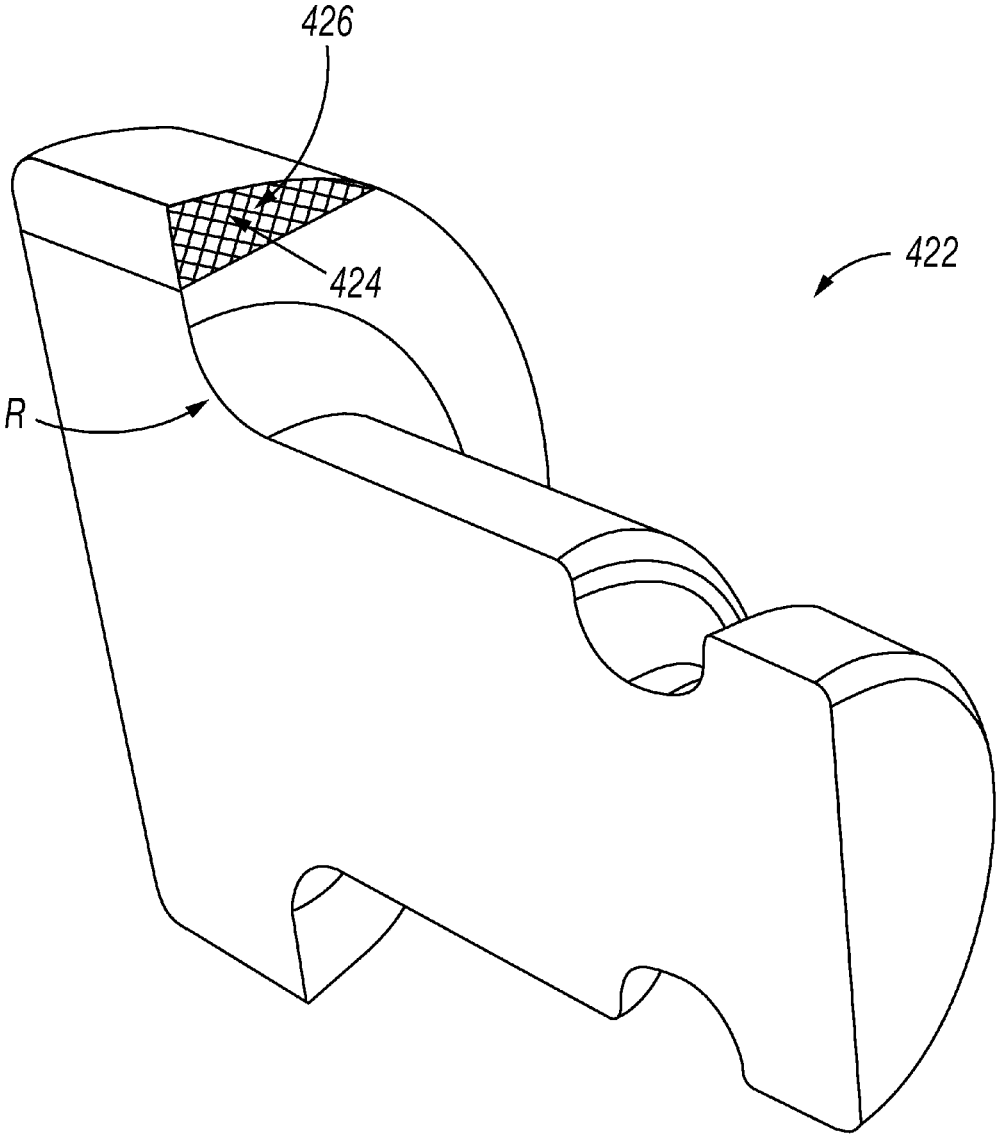
FIG. 42 shows a model setup for simulation of cutting element assemblies according to embodiments of the present disclosure.
Figure 43:
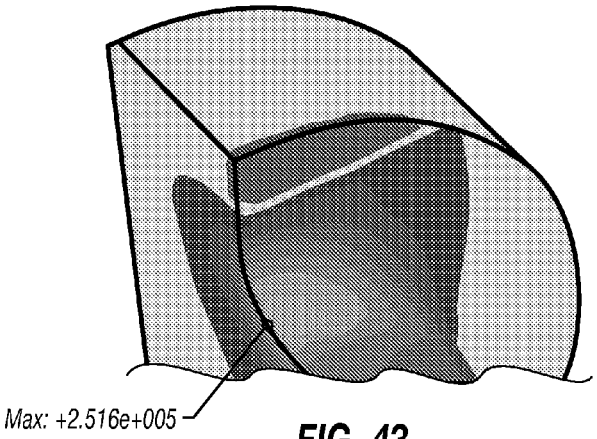
FIGS. 43-45 show partial perspective views of simulation results for cutting elements of the present disclosure.
Figure 44:
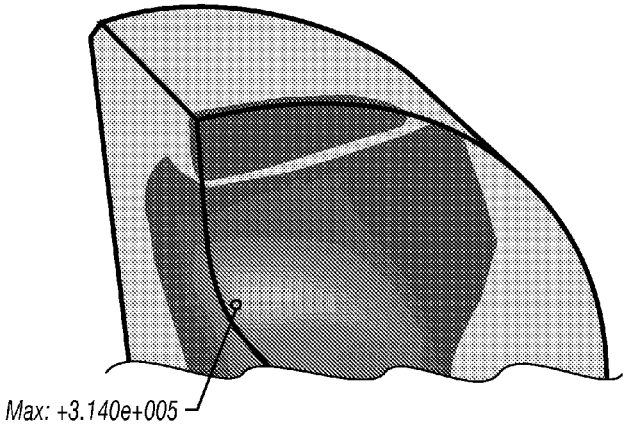
Figure 45:
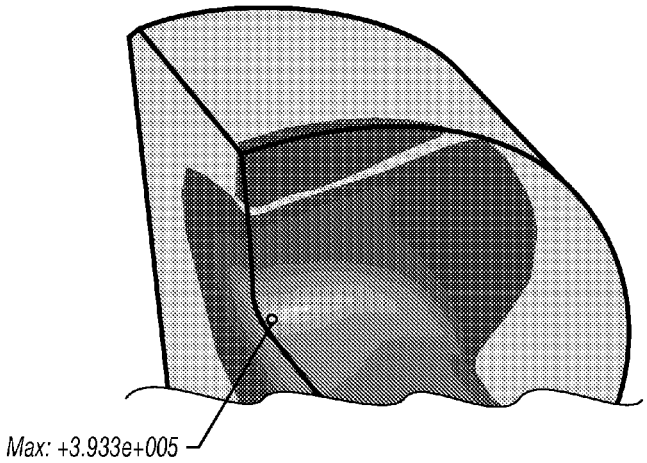
Figure 46:
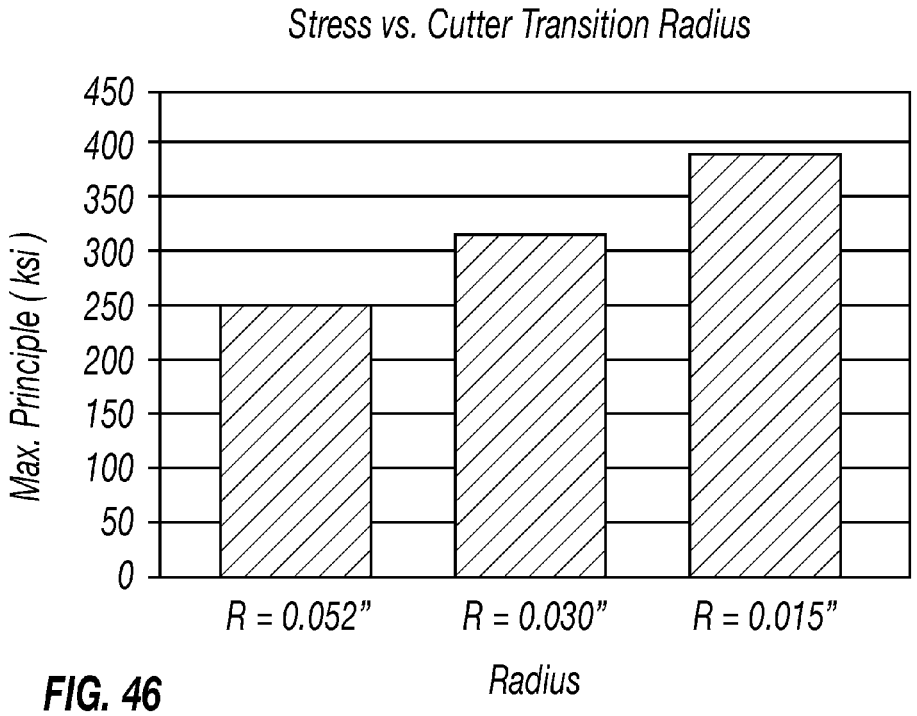
FIGS. 46 and 47 show graphs of simulation results for cutting elements according to embodiments of the present disclosure.
Figure 47:
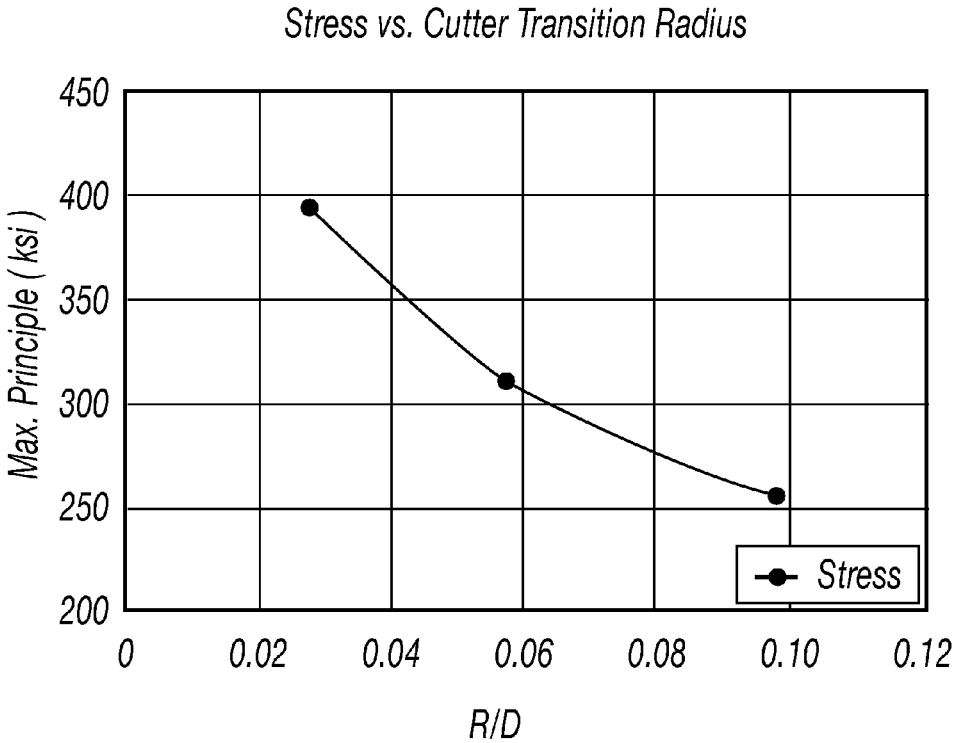

FIG. 42 shows a FEA model setup to test the performance of a radius transition R of a cutting element 422 under a load 424 of 1,000 lbf exerted at the shoulder 426, or upper portion, of the cutting element. FIGS. 43-45 show results from the FEA model setup shown in FIG. 42. Particularly, FIG. 43 shows a partial view of a cutting element with a 0.052 inch radius transition, FIG. 44 shows a partial view of a cutting element with a 0.03 inch radius transition, and FIG. 45 shows a partial view of a cutting element with a 0.015 inch radius transition. FIG. 46 shows a graph of the maximum principle stress resulting from the simulations shown in FIGS. 43-45. As shown, higher maximum principle stress results in the cutting element simulated with a radius transition of 0.015 inches and a relatively lower maximum principle stresses result in the cutting elements simulated with smaller radii transitions. FIG. 47 shows the results in FIG. 46 in relation with the diameter of the cutting element. Particularly, FIG. 47 shows a comparison between the maximum principle stress in a cutting element and the ratio of the cutting element radius transition to the cutting element diameter.

Figure 48:
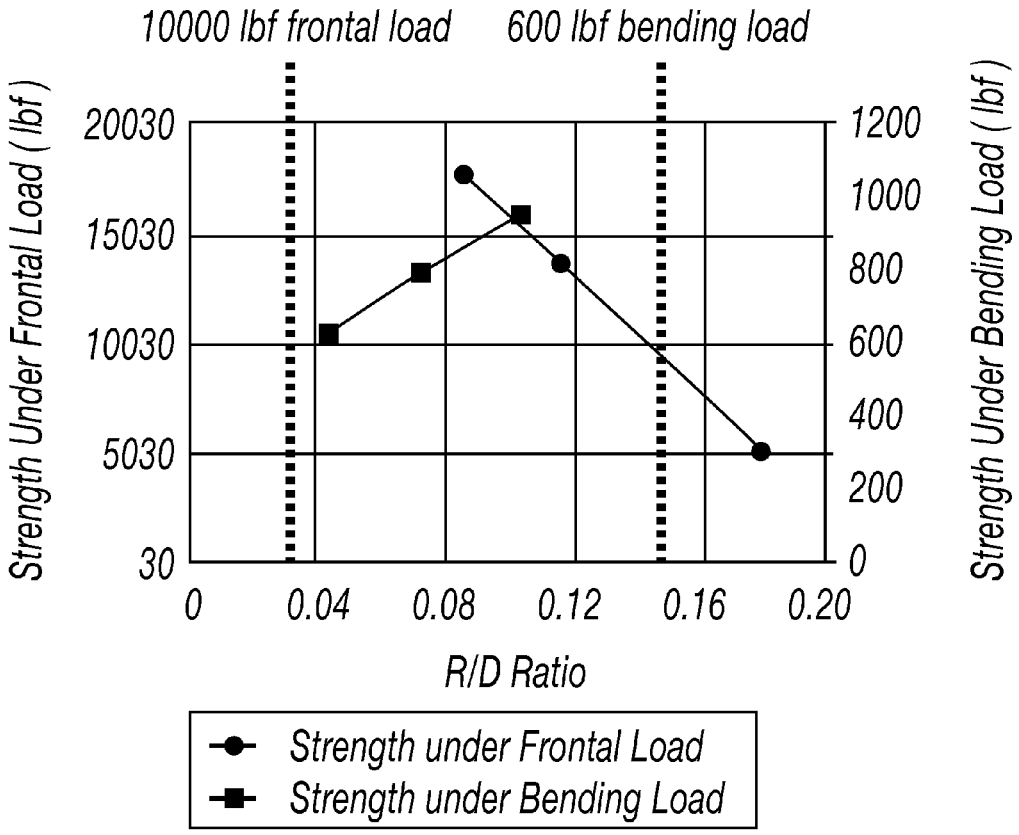
FIG. 48 shows a graph of testing results for cutting elements according to embodiments of the present disclosure.

Referring now to FIG. 48, a graph shows the strength of cutting elements under a frontal load and under a bending load in relation to the ratio of the cutting element radius transition and the cutting element diameter (R/D). According to embodiments of the present disclosure, a cutting element may have a radius transition to diameter ratio (R/D ratio) ranging from 0.075 to 0.125. For example, a cutting element having a 13 mm diameter may have a R/D ratio ranging from 0.075 to 0.115, and a cutting element having a 16 mm diameter may have a R/D ratio ranging from 0.08 to 0.12.

Lower Spindle Distance (p) for Retention

Figure 49:
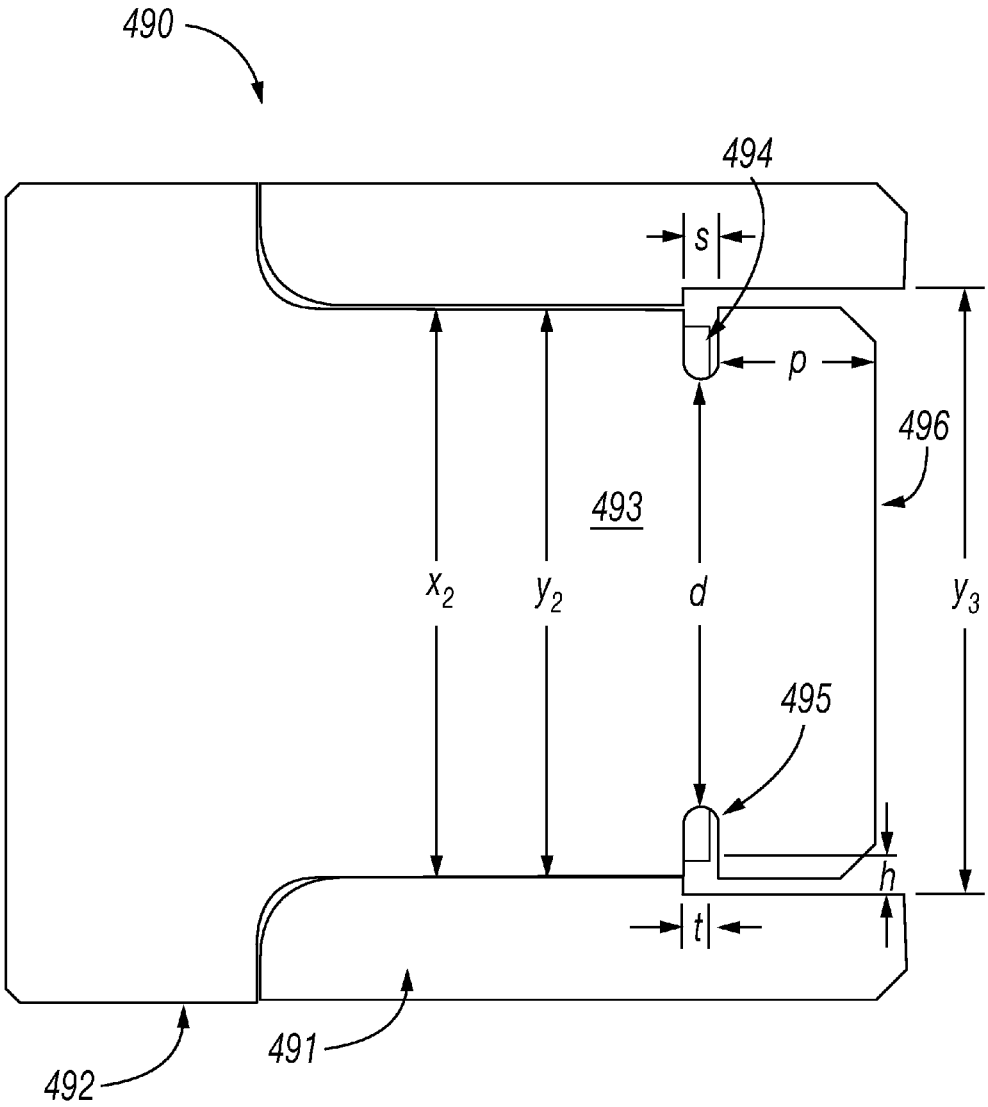
FIG. 49 shows a cross sectional view of a cutting element assembly according to embodiments of the present disclosure.

Referring to FIG. 49, a cutting element assembly 490 includes a sleeve 491 and a cutting element 492 retained within the sleeve 491. A lower portion 493 of the cutting element 492 forms a spindle around which the sleeve 491 is disposed. The cutting element 492 may be retained within the sleeve by a retention ring 494 to limit the axial movement or displacement of the cutting element 492 with respect to sleeve 491. As shown, the sleeve 491 has a first inner diameter $Y_2$ and a second inner diameter $Y_3$ larger than the first inner diameter $Y_2$. The cutting element spindle 493 has a diameter $X_2$ and a groove 495 formed therein with a diameter d and a width s. The retention ring 494 is disposed in the groove and extends past the first inner diameter $Y_2$ toward the second inner diameter $Y_3$ of the sleeve 491 to axially retain the cutting element 492. The retention ring 494 has a thickness t and a height h. Further, the groove 495 is positioned a distance p from the back face 496 of the cutting element 492.

According to embodiments of the present disclosure, a cutting element may be retained within a sleeve using a retention mechanism disposed between the cutting element and the sleeve. The retention mechanism may include a retention ring, such as shown in FIG. 49, retention balls, retention pins or other retention mechanisms known in the art disposed in a groove formed in the spindle of the cutting element. In one or more embodiments, such retention mechanisms may include those described in U.S. Patent Application No. 61/712,794, which is assigned to the present assignee and herein incorporated by reference in its entirety, such as a closed loop retention ring extending more 1.5 times around the circumference of the cutting element. However, other retention mechanisms may also be used. Cutting element assemblies having a small distance p from the back face of the cutting element to the groove may result in increased amounts of stress in the cutting element region p. According to embodiments of the present disclosure, a distance p from a cutting element back face to a retention groove may be greater than or equal to 0.03 inches. Further, different types of retention mechanisms used to retain the cutting element within the sleeve may result in different amounts of stress in the cutting element region p. For example, a cutting element retained within a sleeve by a retention ring may result in a different amount of stress in the cutting element region p than the amount of stress resulting from a cutting element retained within a sleeve by retention balls, wherein both cutting element assemblies have equal distances p.

Figure 50:
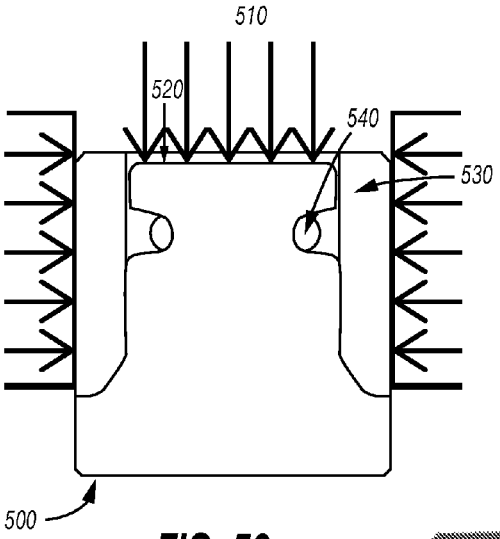
FIG. 50 shows a model setup for simulation of cutting element assemblies according to embodiments of the present disclosure.
Figure 51:
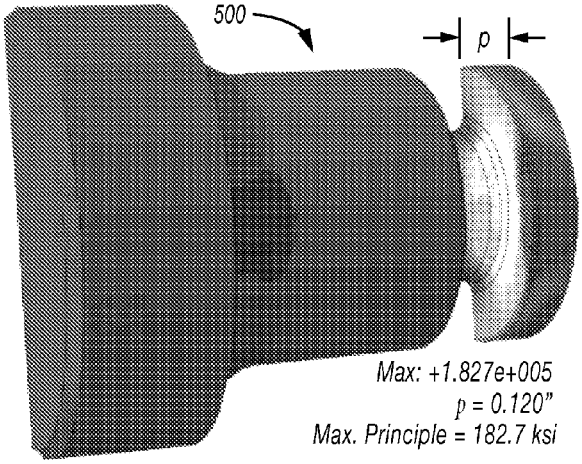
FIGS. 51 and 52 show simulation results for cutting elements according to embodiments of the present disclosure.
Figure 52:
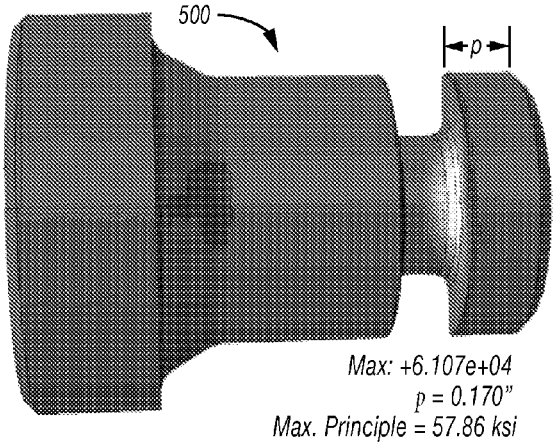

FIGS. 50-52 show FEA analysis of the performance of cutting elements 500 retained within a sleeve 530 using retention balls 540 with various values of p (the distance between the groove and the back face of the cutting element) when the cutting elements experience a load 510 of 2,000 lbf on the back face 520 of the cutting elements (may be referred to as a "push out load"). Particularly, FIG. 50 shows the FEA setup, FIG. 51 shows a simulated cutting element 500 having a distance p equal to 0.120 inches, and FIG. 52 shows a simulated cutting element 500 having a distance p equal to 0.170 inches.

Figure 53:
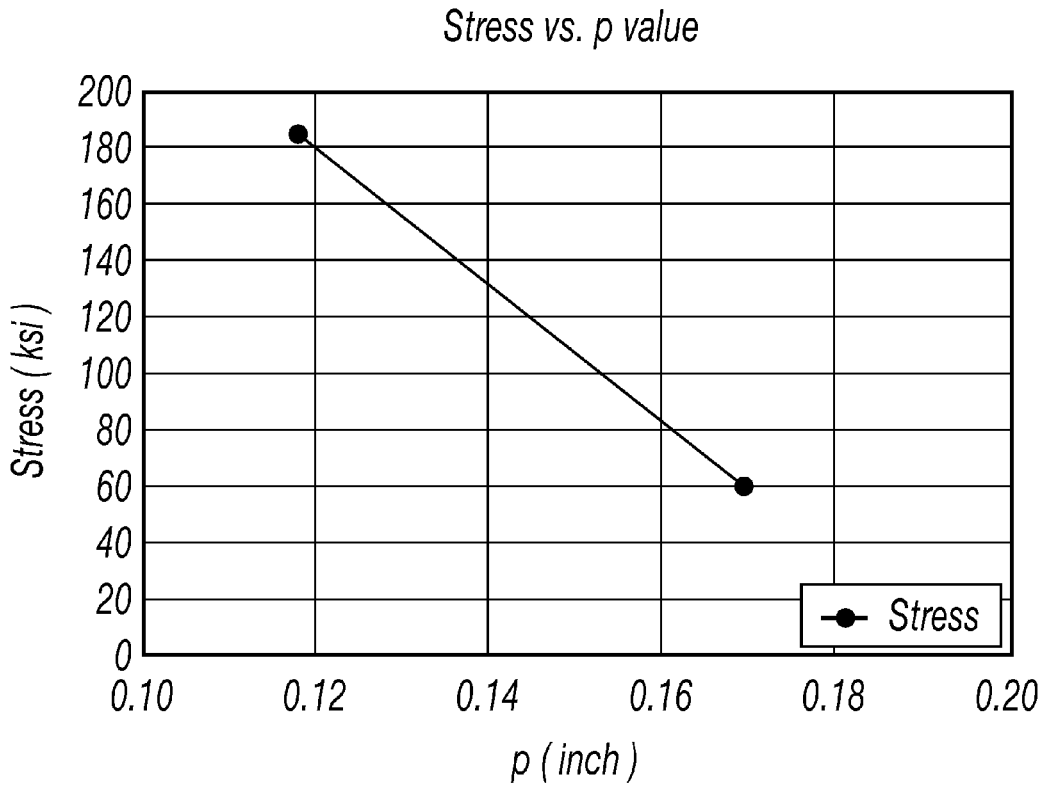
FIGS. 53 and 54 show graphs of simulation results for cutting elements according to embodiments of the present disclosure.
Figure 54:
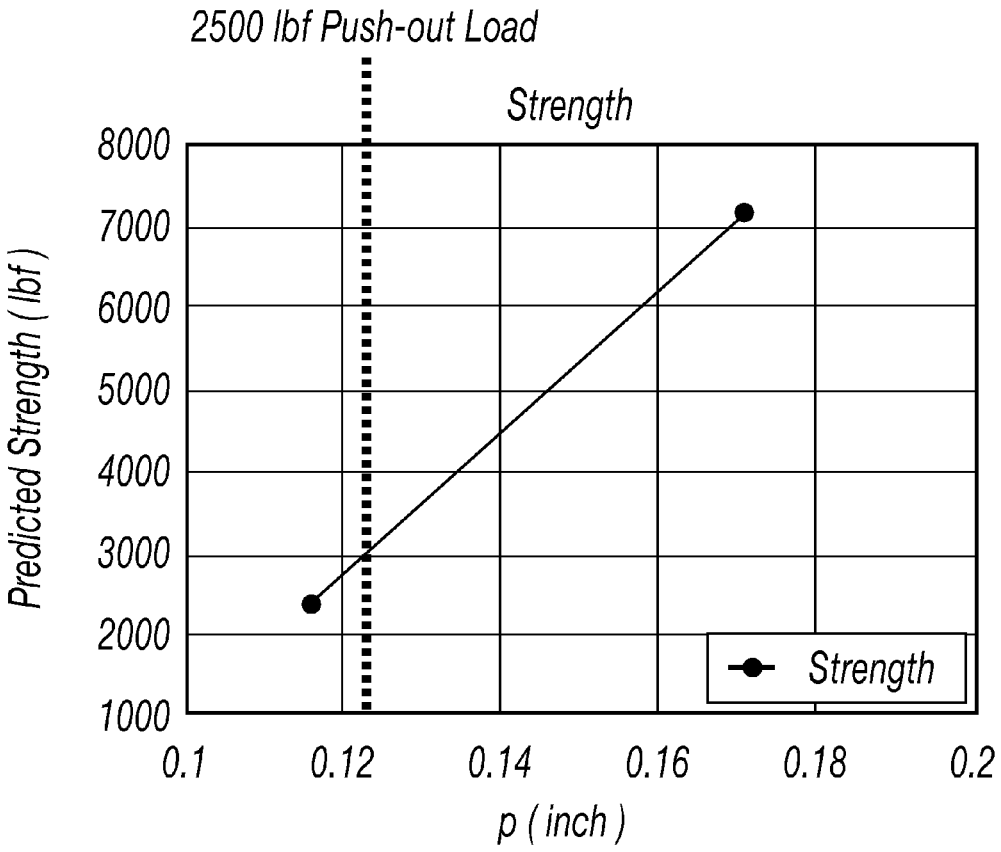

FIGS. 53 and 54 show graphs of the simulation results for the FEA setup shown in FIG. 50. FIG. 53 shows the amount of stress calculated in the FEA analysis for cutting elements having various p values. For example, a cutting element having a p value equal to 0.17 inches may result in a stress of about 60 ksi upon simulation of a 2,000 lbf push out load, and a cutting element having a p value equal to 0.12 inches may result in a stress of about 180 ksi upon simulation of a 2,000 lbf push out load. FIG. 54 shows the predicted strength of the cutting elements having various p values. The predicted strength of a cutting element may be calculated using the equation $F_S=F*S_{UT}/S$, where $F_S$ is the predicted strength, F is the load applied in the FEA analysis, $S_{UT}$ is the ultimate tensile stress of the cutting element (220 ksi), and S is the stress calculated in the FEA analysis. Based on lab testing, inventors of the present disclosure have found that 2,500 lbf may be a lower limit of load applied to the back face of a cutting element.

Gap Between Cutting Element Assembly and Cutter Pocket

Figure 55:
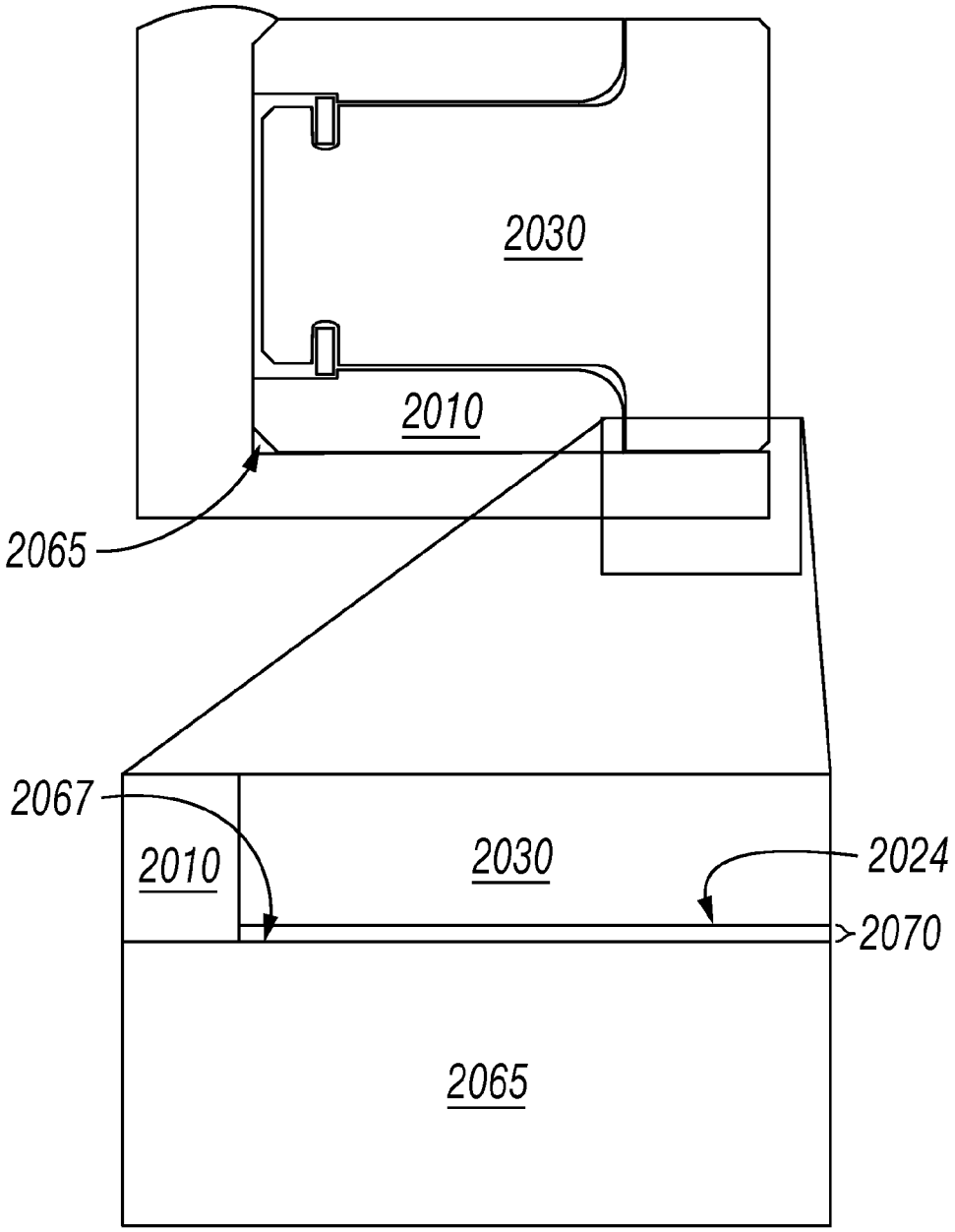
FIG. 55 shows an exploded cross sectional partial view of a cutting element assembly according to embodiments of the present disclosure.

According to embodiments of the present disclosure, an upper portion of a cutting element may be radially aligned or non-aligned with the outer surface of a sleeve. For example, referring now to FIG. 55, a sleeve 2010 and a cutting element 2030 are disposed in a cutter pocket 2065 formed in a drilling tool. The sleeve 2010 extends a radial distance farther than the upper portion of the cutting element 2030 (i.e., the diameter between the outer surface of the sleeve is larger than the diameter of the upper portion of the cutting element), such that a gap is formed between the side surface 2024 of the upper portion of the cutting element and the cutter pocket side wall 2067. As shown, the outer surface of the sleeve 2010 may be adjacent to the cutter pocket side wall 2067, while the side surface 2024 of the upper portion of the cutting element 2030 is a distance 2070 from the cutter pocket side wall 2067.

According to some embodiments, a sleeve and the upper portion of a cutting element may be radially aligned (i.e., have approximately the same diameter), such that the outer surface of the sleeve and side surface of the upper portion of the cutting element are substantially aligned. In some embodiments, the outer surface of the sleeve and the side surface of the upper portion of the cutting element may be substantially aligned and adjacent to the cutter pocket side wall (without a gap between the side surface of the upper portion of the cutting element and the cutter pocket side wall). In some embodiments, the outer surface of the sleeve and the side surface of the upper portion of the cutting element may be substantially aligned and may be positioned a distance from the cutter pocket side wall (with a gap between the cutter pocket side wall and the substantially aligned outer surface of the sleeve and side surface of the upper portion of the cutting element). In some embodiments, the outer surface of the sleeve and the side surface of the upper portion of the cutting element may be substantially aligned and may be positioned a distance from the cutter pocket side wall, wherein a braze material is disposed between the sleeve and the cutter pocket. In such embodiments, a gap may remain between the cutter pocket side wall and the side surface of the upper portion of the cutting element, wherein the gap is substantially equal to the thickness of the braze material disposed between the cutter pocket side wall and the outer surface of the sleeve.

In some embodiments, a sleeve may extend a radial distance shorter than the upper portion of the cutting element (i.e., the diameter between the outer surface of the sleeve is smaller than the diameter of the upper portion of the cutting element), such that a gap is formed between the outer surface of the sleeve and the cutter pocket side wall. For example, the outer surface of the sleeve may be a distance from the cutter pocket side wall, while the side surface of the upper portion of the cutting element may be adjacent to the cutter pocket side wall. The distance apart between the sleeve and the cutter pocket side wall may provide space for a brazing material to be disposed between the cutter pocket side wall and the sleeve holding the cutting element. Embodiments of cutting element assemblies having a gap formed between a cutter pocket side wall are also described in Provisional Application No. 61/746,064, filed Dec. 26, 2012, which is incorporated herein by reference.

According to embodiments of the present disclosure, a gap distance between the side surface of the upper portion of a cutting element and the cutter pocket side wall and/or between the outer surface of the sleeve and the cutter pocket side wall may range from about 0.003 inches to about 0.005 inches. In some embodiments, a gap distance between the side surface of the upper portion of a cutting element and the cutter pocket side wall and/or between the outer surface of the sleeve and the cutter pocket side wall may be less than 0.003 inches.

Further, it is specifically intended that one or more (including but not necessarily requiring all) of the above relationships may be present in a cutting assembly that falls within the scope of the present disclosure.

In embodiments using a sleeve, such sleeve may be fixed to the bit body (or other cutting tool) by any means known in the art, including by casting in place during sintering the bit body (or other cutting tool) or by brazing the element in place in the cutter pocket (not shown). Brazing may occur before or after the inner cutting element is retained within the sleeve; however, in particular embodiments, the inner rotatable cutting element is retained in the sleeve before the sleeve is brazed into place.

Each of the embodiments described herein have at least one ultrahard material included therein. Such ultra hard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by substantially removing metal from the interstitial spaces between interconnected diamond particles or from a diamond/silicon carbide composite, or other ultra hard material such as a cubic boron nitride. Further, in particular embodiments, the inner rotatable cutting element may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are generally found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, such as hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

In one or more other embodiments, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is optionally disposed may be formed of a variety of hard or ultra hard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultra hard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be desirable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

The sleeve may be formed from a variety of materials. In one embodiment, the sleeve may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. In a particular embodiment, the outer support element is a cemented tungsten carbide with a cobalt content ranging from 6 to 13 percent. It is also within the scope of the present disclosure that the sleeve and/or substrate may also include one more lubricious materials, such as diamond to reduce the coefficient of friction therebetween. The components may be formed of such materials in their entirely or have portions of the components including such lubricious materials deposited on the component, such as by chemical plating, chemical vapor deposition (CVD) including hollow cathode plasma enhanced CVD, physical vapor deposition, vacuum deposition, arc processes, or high velocity sprays). In a particular embodiment, a diamond-like coating may be deposited through CVD or hallow cathode plasma enhanced CVD, such as the type of coatings disclosed in US 2010/0108403, which is assigned to the present assignee and herein incorporated by reference in its entirety.

In other embodiments, the sleeve may be formed of alloy steels, nickel-based alloys, and cobalt-based alloys. One of ordinary skill in the art would also recognize that cutting element components may be coated with a hardfacing material for increased erosion protection. Such coatings may be applied by various techniques known in the art such as, for example, detonation gun (d-gun) and spray-and-fuse techniques.

The cutting elements of the present disclosure may be incorporated in various types of cutting tools, including for example, as cutters in fixed cutter bits or hole enlargement tools such as reamers. Bits having the cutting elements of the present disclosure may include a single rotatable cutting element with the remaining cutting elements being conventional cutting elements, all cutting elements being rotatable, or any combination therebetween of rotatable and conventional cutting elements. Further, cutting elements of the present disclosure may be disposed on cutting tool blades (such as drag bit blades or reamer blades) having other wear elements incorporated therein. For example, cutting elements of the present disclosure may be disposed on diamond impregnated blades.

In some embodiments, the placement of the cutting elements on the blade of a fixed cutter bit may be selected such that the rotatable cutting elements are placed in areas experiencing the greatest wear. For example, in a particular embodiment, rotatable cutting elements may be placed on the shoulder or nose area of a fixed cutter bit. Additionally, one of ordinary skill in the art would recognize that there exists no limitation on the sizes of the cutting elements of the present disclosure. For example, in various embodiments, the cutting elements may be formed in sizes including, but not limited to, 9 mm, 13 mm, 16 mm, and 19 mm.

Further, one of ordinary skill in the art would also appreciate that any of the design modifications as described above, including, for example, side rake, back rake, variations in geometry, surface alteration/etching, seals, bearings, material compositions, diamond or similar low-friction bearing surfaces, etc., may be included in various combinations not limited to those described above in the cutting elements of the present disclosure. In one embodiment, a cutter may have a side rake ranging from 0 to ±45 degrees. In another embodiment, a cutter may have a back rake ranging from about 5 to 35 degrees.

A cutter may be positioned on a blade with a selected back rake to assist in removing drill cuttings and increasing rate of penetration. A cutter disposed on a drill bit with side rake may be forced forward in a radial and tangential direction when the bit rotates. In some embodiments because the radial direction may assist the movement of inner rotatable cutting element relative to outer support element, such rotation may allow greater drill cuttings removal and provide an improved rate of penetration. One of ordinary skill in the art will realize that any back rake and side rake combination may be used with the cutting elements of the present disclosure to enhance rotatability and/or improve drilling efficiency.

As a cutting element contacts formation, the rotating motion of the cutting element may be continuous or discontinuous. For example, when the cutting element is mounted with a determined side rake and/or back rake, the cutting force may be generally pointed in one direction. Providing a directional cutting force may allow the cutting element to have a continuous rotating motion, further enhancing drilling efficiency.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. A cutter assembly, comprising:

a sleeve; and at least one cutting element having a lower spindle portion retained in the sleeve and a portion of the cutting element interfacing an axial bearing surface of the sleeve, wherein an outer diameter D of the cutting element and a radial length T of a substantially planar portion of the axial bearing surface of the sleeve have the following relationship: $(1/25)D \leq T \leq (1/4)D$.

2. The cutter assembly of claim 1, wherein an outer diameter D of the cutting element, a radial length T of an outermost substantially planar portion of the axial bearing surface of the sleeve, and a thickness d of the sleeve have the following relationship: $T \leq d \leq (1/3)D$.

3. The cutter assembly of claim 1, wherein the cutting element comprises a carbide substrate and an ultrahard layer thereon, wherein a lower portion of the carbide substrate comprises the lower spindle portion and an upper portion of the carbide substrate interfaces the axial bearing surface, and wherein an axial extension U of the carbide substrate from the axial bearing surface to the ultrahard layer and a thickness S of the ultrahard layer have the following relationship: $U/S \geq 0.5$.

4. The cutter assembly claim 1, wherein the cutting element comprises a carbide substrate and an ultrahard layer thereon, wherein a lower portion of the carbide substrate comprises the lower spindle portion and an upper portion of the carbide substrate interfaces the axial bearing surface, and wherein an axial extension U of the carbide substrate from the axial bearing surface to the ultrahard layer, a thickness S of the ultrahard layer, and a height L of the cutting assembly have the following relationship: $U+S \leq 0.75L$.

5. The cutter assembly of claim 1, wherein the lower spindle portion comprises a retention cavity therein; and wherein the cutter assembly further comprises a retention element interfacing the retention cavity to retain the cutting element in the sleeve, wherein a diameter J of the lower spindle portion axially above the retention cavity and a diameter j of the lower spindle portion axially below the retention cavity have the following relationship: $J-0.07 \leq j \leq J$.

6. A downhole cutting tool, comprising:

a cutting element support structure having at least one cutter pocket formed therein; and a cutter assembly of claim 1 disposed in the cutter pocket.

7. A cutter assembly, comprising:

a sleeve; and at least one cutting element having a lower spindle portion retained in the sleeve and a portion of the cutting element interfacing an axial bearing surface of the sleeve, wherein an outer diameter D of the cutting element, a radial length T of an outermost substantially planar portion of the axial bearing surface of the sleeve, and a thickness d of the sleeve have the following relationship: $T \leq d \leq (1/3)D$.

8. The cutter assembly of claim 7, wherein the cutting element comprises a carbide substrate and an ultrahard layer thereon, wherein a lower portion of the carbide substrate comprises the lower spindle portion and an upper portion of the carbide substrate interfaces the axial bearing surface, and wherein an axial extension U of the carbide substrate from the axial bearing surface to the ultrahard layer and a thickness S of the ultrahard layer have the following relationship: $U/S \geq 0.5$.

9. The cutter assembly of claim 7, wherein the cutting element comprises a carbide substrate and an ultrahard layer thereon, wherein a lower portion of the carbide substrate comprises the lower spindle portion and an upper portion of the carbide substrate interfaces the axial bearing surface, and wherein an axial extension U of the carbide substrate from the axial bearing surface to the ultrahard layer, a thickness S of the ultrahard layer, and a height L of the cutting assembly have the following relationship: $U+S \leq 0.75L$.

10. The cutter assembly of claim 7, wherein the lower spindle portion comprises a retention cavity therein; and wherein the cutter assembly further comprises a retention element interfacing the retention cavity to retain the cutting element in the sleeve, wherein a diameter J of the lower spindle portion axially above the retention cavity and a diameter j of the lower spindle portion axially below the retention cavity have the following relationship: $J-0.07 \leq j \leq J$.

11. A cutter assembly, comprising:

a sleeve; and at least one cutting element comprising: a carbide substrate and an ultrahard layer thereon, wherein a portion of the carbide substrate comprises a lower spindle portion retained in the sleeve and an upper portion interfacing an axial bearing surface of the sleeve, wherein an axial extension U of the carbide substrate from the axial bearing surface to the ultrahard layer and a thickness S of the ultrahard layer have the following relationship: $U/S \geq 0.5$.

12. The cutter assembly of claim 11, wherein an axial extension U of the carbide substrate from the axial bearing surface to the ultrahard layer, a thickness S of the ultrahard layer and a height L of the cutting assembly have the following relationship: $U+S \leq 0.75L$.

13. The cutter assembly of claim 11, wherein the lower spindle portion comprises a retention cavity therein; and wherein the cutter assembly further comprises a retention element interfacing the retention cavity to retain the cutting element in the sleeve, wherein a diameter J of the lower spindle portion axially above the retention cavity and a diameter j of the lower spindle portion axially below the retention cavity have the following relationship: $J-0.07 \leq j \leq J$.

14. A cutter assembly, comprising:

a sleeve; and at least one cutting element comprising: a carbide substrate and an ultrahard layer thereon, wherein a portion of the carbide substrate comprises a lower spindle portion retained in the sleeve and an upper portion interfacing an axial bearing surface of the sleeve, wherein an axial extension U of the carbide substrate from the axial bearing surface to the ultrahard layer, a thickness S of the ultrahard layer, and a height L of the cutting assembly have the following relationship: $U+S \leq 0.75L$.

15. The cutter assembly of claim 14, wherein the lower spindle portion comprises a retention cavity therein; and wherein the cutter assembly further comprises a retention element interfacing the retention cavity to retain the cutting element in the sleeve, wherein a diameter J of the lower spindle portion axially above the retention cavity and a diameter j of the lower spindle portion axially below the retention cavity have the following relationship: $J-0.07 \leq j \leq J$.

16. A cutter assembly, comprising:

a sleeve;

at least one cutting element having lower spindle portion retained in the sleeve and an upper portion interfacing an axial bearing surface of the sleeve, wherein the lower spindle portion comprises a retention cavity therein; and a retention element interfacing the retention cavity to retain the cutting element in the sleeve, wherein a diameter J of the lower spindle portion axially above the retention cavity and a diameter j of the lower spindle portion axially below the retention cavity have the following relationship: $J-0.07 \leq j \leq J$.

17. The cutter assembly of claim 16, wherein the cutting element is retained such that the cutting element is capable of rotating about a longitudinal axis thereof.

18. The cutter assembly of claim 16, wherein a gap between a back face of the at least one cutting element and a back face of the at least one sleeve is less than 0.040 inches.

* * * * *